US010777117B2

(12) United States Patent
Ozaki

(10) Patent No.: US 10,777,117 B2
(45) Date of Patent: Sep. 15, 2020

(54) IMAGE PROCESSING DEVICE, IMAGE PROCESSING METHOD AND DISPLAY SYSTEM

(71) Applicant: Japan Display Inc., Minato-ku (JP)

(72) Inventor: Tadafumi Ozaki, Minato-ku (JP)

(73) Assignee: Japan Display Inc., Minato-ku (JP)

( * ) Notice: Subject to any disclaimer, the term of this patent is extended or adjusted under 35 U.S.C. 154(b) by 154 days.

(21) Appl. No.: 16/010,893

(22) Filed: Jun. 18, 2018

(65) Prior Publication Data

US 2019/0005864 A1 Jan. 3, 2019

(30) Foreign Application Priority Data

Jun. 30, 2017 (JP) ..... 2017-128475

(51) Int. Cl.

*G09G 5/02* (2006.01)
*G09G 3/20* (2006.01)
*G09G 3/36* (2006.01)

(52) U.S. Cl.

CPC ..... *G09G 3/2059* (2013.01); *G09G 3/3607* (2013.01); *G09G 2320/0247* (2013.01); *G09G 2330/10* (2013.01); *G09G 2340/06* (2013.01)

(58) Field of Classification Search

CPC ..... G09G 3/2059; G09G 3/3607; G09G 2320/0247; G09G 2330/10

USPC ..... 345/694

See application file for complete search history.

(56) References Cited

U.S. PATENT DOCUMENTS

| | | | | |
|---|---|---|---|---|
| 6,999,201 | B1 | 2/2006 | Shimizu | |
| 8,208,175 | B2 | 6/2012 | Xu et al. | |
| 9,019,293 | B2 | 4/2015 | Tsuzaki et al. | |
| 2012/0182305 | A1* | 7/2012 | Tsuzaki | G09G 3/2059 345/589 |
| 2014/0294298 | A1* | 10/2014 | Palanivel | H04N 1/40075 382/167 |
| 2016/0344895 | A1* | 11/2016 | Puigardeu Aramendia | H04N 1/4052 |

FOREIGN PATENT DOCUMENTS

| | | |
|---|---|---|
| JP | 2000-341520 | 12/2000 |
| JP | 2006-295940 | 10/2006 |
| JP | 2012-145821 | 8/2012 |

* cited by examiner

*Primary Examiner* — Jonathan M Blancha
(74) *Attorney, Agent, or Firm* — Oblon, McClelland, Maier & Neustadt, L.L.P.

(57) ABSTRACT

An image processing device including a storage part storing an error value corresponding to at least one of second pixels in an image display device, the image display device having a display screen, the display screen having a plurality of pixels, the plurality of pixels having a first pixel and the second pixels, the second pixels surrounding a first pixel, a pixel data calculating pixel data corresponding to the first pixel based on a coefficient in response to a gradation of input data in the second pixel and the error value corresponding to the second pixel, a quantized data calculator quantizing the calculated pixel data and calculating quantized data, and an error value calculator corresponding the calculated pixel data and an error value with the quantized data and storing in the storage part.

18 Claims, 19 Drawing Sheets

IMAGE PROCESSING DEVICE, IMAGE PROCESSING METHOD AND DISPLAY SYSTEM

CROSS REFERENCE TO RELATED APPLICATIONS

This application is based upon and claims the benefit of priority from the prior Japanese Patent Application No. 2017-128475, filed on Jun. 30, 2017, the entire contents of which are incorporated herein by reference.

FIELD

One embodiment of the present invention is related to an image processing device, an image processing method and a display system mounted with these.

BACKGROUND

For example, a liquid crystal display panel for monochrome display or color display, an electroluminescence display panel using the electroluminescence of an inorganic material or an organic material, and a plasma display panel and the like are used in the display part of a mobile electronic device such as a mobile phone and a mobile information terminal, or a display part such as a personal computer and a television receiver.

In the case where the gradation display capability of pixels of the display part is low, in other words, when the number of gradations of the pixels is small, a contour-like line is generated in the gradation part of the image, and image quality deteriorates. In such a case, it is known that image quality is improved by using an error diffusion method.

For example, a technique has been developed in which a display surface is divided into a plurality of sections (error diffusion blocks), and error diffusion is performed only in each section. The transmission range of a change in error diffusion on the display surface is limited by this technique. Therefore, flickering on the screen on the display surface is reduced by this technique.

SUMMARY

An image processing device includes a storage part storing an error value corresponding to at least one of second pixels in an image display device, the image display device having a display screen, the display screen having a plurality of pixels, the plurality of pixels having a first pixel and the second pixels, the second pixels surrounding the first pixel, a pixel data calculator calculating pixel data corresponding to the first pixel based on a coefficient in response to a gradation of an input data in the second pixel and the error value corresponding to the second pixel, a quantized data calculator quantizing the calculated pixel data and calculating quantized data, and an error value calculator corresponding the calculated pixel data and an error value with the quantized data and storing in the storage part.

An image processing method includes dividing a display screen into a plurality of regions and performing an error diffusion process on input data input to an image processing device including the display screen having a plurality of pixels, storing an error value corresponding to the pixel in a storage part, calculating pixel data corresponding to a first pixel based on a coefficient in response to a gradation of the input data in a second pixel and the error value corresponding to the second pixel surrounding a first pixel included in the plurality of pixels, quantizing the pixel data and calculating quantized data, calculating an error value based on the pixel data and the quantized data, and corresponding the error value with the first pixel and storing in the storage part.

An image display system includes the image processing device and an image display device including a display screen having a plurality of pixels, and a gradation of the pixel is controlled based on data on which the image processing device has performed an error diffusion processing.

DESCRIPTION OF EMBODIMENTS

Figure 1:
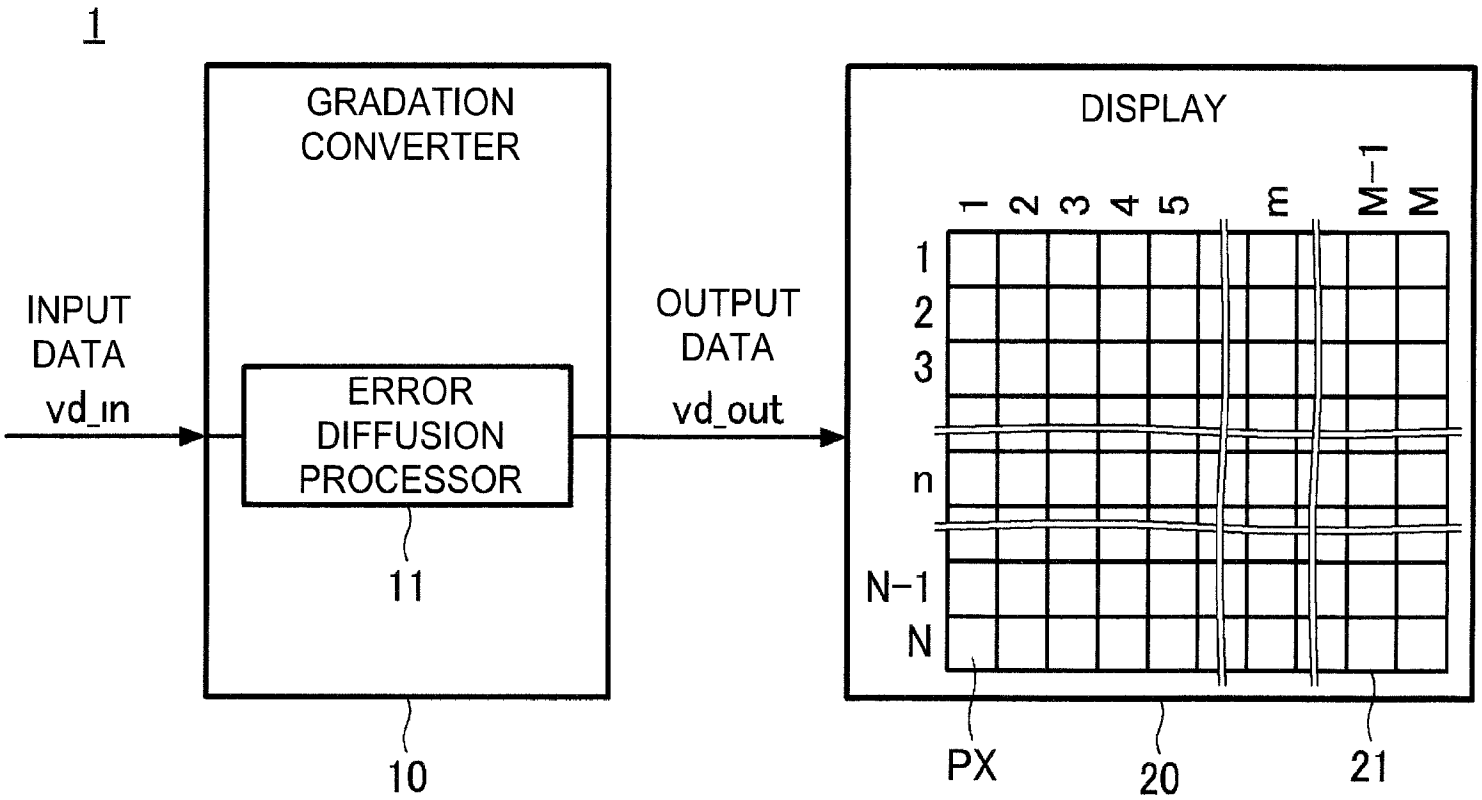
FIG. 1 is a schematic diagram of an image display system according to one embodiment of the present invention.

The embodiments of the present invention are explained below while referring to the drawings. However, the present invention can be carried out in many different modes and is not to be interpreted as being limited to the description of the embodiments exemplified herein. In addition, although the structure of each part may be schematically represented compared with their actual form in order to make the explanation clearer, such explanation is only an example and does not limit an interpretation of the present invention. Furthermore, in the present specification and each diagram, elements similar to those described above with reference to a previously mentioned figure are denoted with the same reference numerals (or reference numerals followed by numerals such as a and b) and a detailed explanation may be omitted as appropriate.

Furthermore, letters added with "first" and "second" with respect to each element are convenience signs used to distinguish each element and do not have a further meaning unless otherwise specified.

First Embodiment

In the present embodiment, the structure of an image processing device, an image processing method, and an image display device mounted with the same according to one embodiment of the present invention is explained.

FIG. 1 is a conceptual diagram of an image display system 1 according to the present embodiment. As is shown in the diagram, the image display system 1 includes a display part 20 and a gradation converter 10. The display part 20 has a display surface 21 including a plurality of pixels PX arranged in a matrix. The gradation converter 10 generates output data vd_out by performing a predetermined gradation conversion process to input data vd_in supplied from an upper device not shown in the diagram. In addition, the gradation converter 10 supplies the output data vd_out to the display part 20.

The display part 20 is formed by, for example, a liquid crystal display panel of a monochrome display. However, the structure and method of the display part 20 are not particularly limited. In addition to the liquid crystal display panel, the display part 20 may be formed from a well-known display device such as an electroluminescence display panel or a plasma display panel. In addition, the display part 20 may be formed by a display medium such as electrically rewritable electronic paper. Furthermore, the display part 20 may be a monochrome display or a color display. Herein, in order to promote understanding of the present embodiment, the display part 20 is explained assuming it is a monochrome display. Therefore, only one input data vd_in is input for one pixel PX in during one frame.

On a display surface 21 of the display part 20, a total of M×N pixels PX are arranged in a two-dimensional matrix in which M number of pixels are arranged in a horizontal direction and N number of pixels are arranged in a vertical direction. In the present specification, it is sometimes described as X (n, m). This indicates that it is a structure X corresponding to a pixel PX located at the nth row and the mth column among a plurality of structures X arranged for each pixel PX. Furthermore, X is an arbitrary structure, n is an integer of 1 to N, and m is an integer of 1 to M.

In the case when the display part 20 is a transmission type display panel, the display part 20 is formed so as to control the light transmittance of each pixel PX based on a value of the output data vd_out supplied from the gradation converter 10. By this control, the amount of light which is transmitted from a light source device not shown in the diagram is controlled, and an image is displayed on the display part 20 as a result. In the case when the display part 20 is a reflection type display panel, the display part 20 is formed to control the light reflectance ratio of each pixel PX based on the value of the output data vd_out supplied from the gradation converter 10. By this control, the amount of reflected external light is controlled, and an image is displayed on the display part 20 as a result.

The gradation converter 10 includes an error diffusion processor 11 which performs gradation processing by the error diffusion method. In addition, the gradation converter 10 is formed to convert input data vd_in(n, m) to output data vd_out(n, m) using the error diffusion processor 11. The output data vd_out(n, m) obtained by this conversion is supplied to the display part 20. Details of conversion processing are described in detail later wile referring to FIG. 3 to FIG. 11.

In addition, the gradation converter 10 stores a plurality of error diffusion blocks BL (see FIG. 2A and FIG. 2B) obtained by dividing the display surface 21 into a plurality of regions. The error diffusion block BL is a virtual region and defines a diffusion range of an error when performing gradation processing by the error diffusion method. However, the error diffusion processor 11 according to the present embodiment does not necessarily perform error diffusion limited to within the error diffusion block BL. This point is also explained in detail later while referring to FIG. 3 to FIG. 11.

Figure 2A:
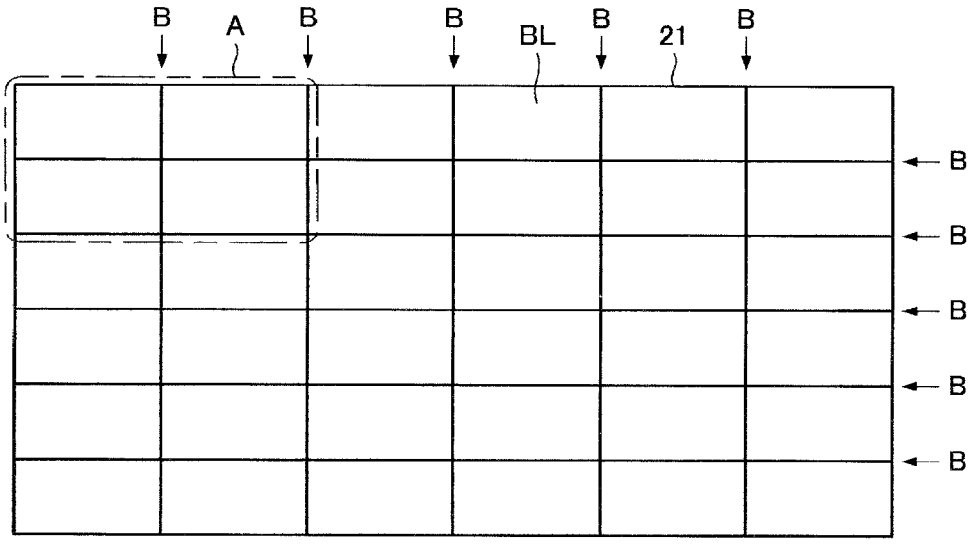
FIG. 2A is a diagram showing an error diffusion block arranged on the display surface shown in FIG. 1.
Figure 2B:
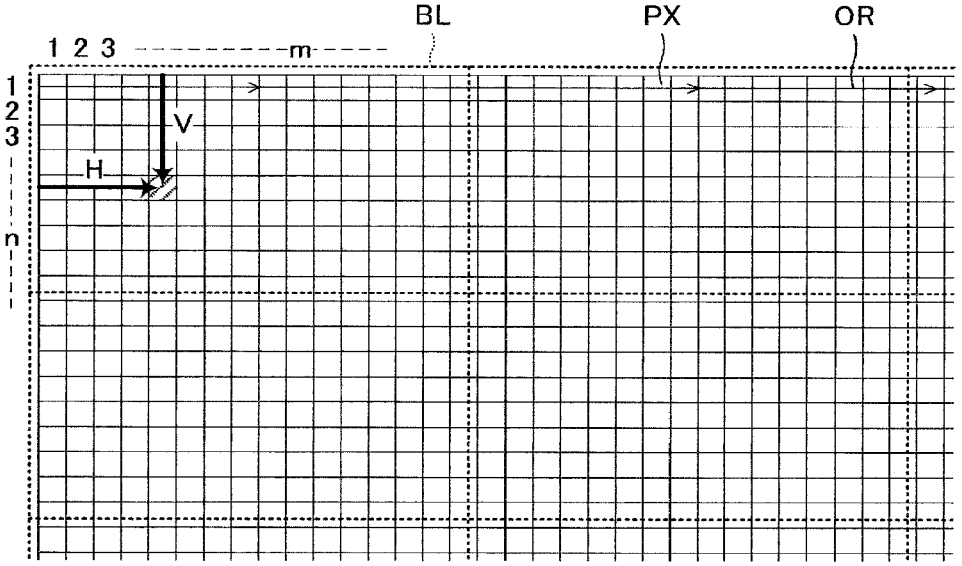
FIG. 2B is an expanded view of the region A shown in FIG. 2A.

FIG. 2A is a diagram showing the error diffusion block BL arranged on the display surface 21. FIG. 2B is an enlarged view of a region A shown in FIG. 2A. An illustration of the pixel PX is omitted in FIG. 2A.

The error diffusion block BL according to one embodiment of the present invention has a rectangular shape each of the same size as is shown in FIG. 2A. In addition, the error diffusion block BL is separated from an adjacent error diffusion block BL at the boundary B. Although an example is shown In FIG. 2A in which the display surface 21 is divided into 6×6=36 error diffusion blocks BL, the division number of error diffusion blocks BL is not limited to the example of FIG. 2A. In one embodiment of the present invention, the number of error diffusion blocks BL is not limited. Although an example is shown in FIG. 2B in which one error diffusion block BL is formed with 16×9=144 pixels PX, the number of pixels PX is not limited to the example in FIG. 2B. In one embodiment of the present invention, the number of pixels PX forming each error diffusion block BL is not limited.

Input data vd_in(n, m) is supplied to the gradation converter 10 in order from the first row (order where n increases by 1 from the top to the bottom). Within each row, the input data vd_in(n, m) is supplied in order along the arrow OR shown in the diagram (order where m increases by 1, from left to right). The error diffusion processor 11 inside the gradation converter 10 is configured to convert the input data vd_in(n, m) supplied sequentially in this way into output data vd_out(n, m) on a pixel PX by a pixel PX at a time and supply the output data vd_out(n, m) to the display part 20. The order along the arrow OR shown in the diagram may also be described as the scanning order. That is, the order along the arrow OR shown in FIG. 2B is a scan from left to right in the upper surface view shown in FIG. 2B. Furthermore, the scanning direction is not limited to scanning from left to right in the upper surface view shown in FIG. 2B. For example, scanning from right to left may be used in the upper surface view shown in FIG. 2B. In this case, in the following explanation, the scanning direction may be read in a mirror inverted position and direction with respect to the vertical direction in the upper surface view, such that right becomes left, lower right becomes lower left, lower left becomes lower right and lower left becomes lower right.

Figure 3:
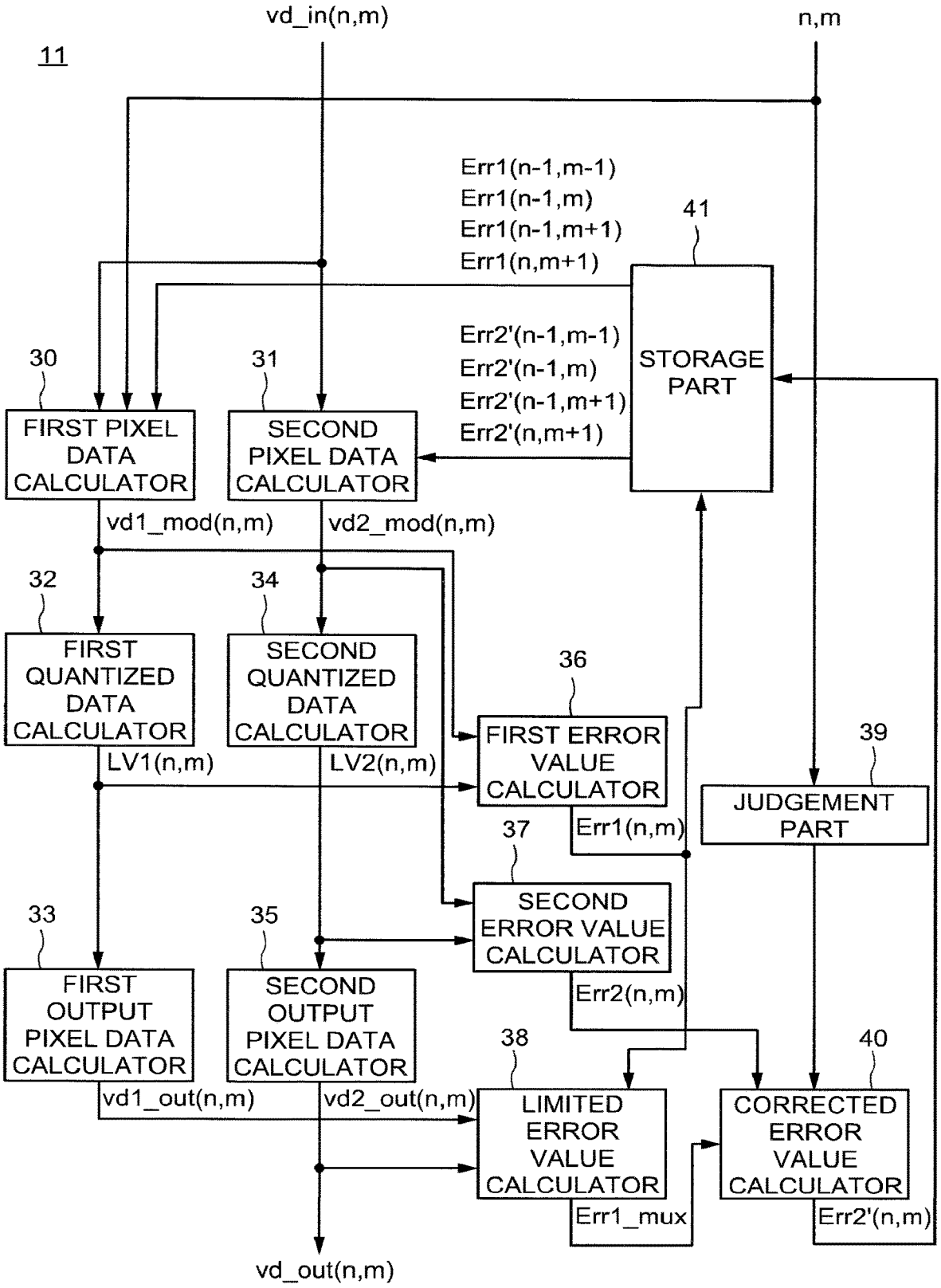
FIG. 3 is a schematic block diagram showing a function block of the error diffusion processor shown in FIG. 1.

FIG. 3 is a schematic block diagram showing a functional block of the error diffusion processor 11. As is shown in the diagram, the error diffusion processor 11 is formed including a first pixel data calculator 30, a second pixel data calculator 31, a first quantized data calculator 32, a first output pixel data calculator 33, a second quantized data calculator 34, a second output pixel data calculator 35, a first error value calculator 36, a second error value calculator 37, a limited error value calculator 38, a judgment part 39, a corrected error value calculator 40 and a storage part 41.

The storage part 41 is formed to store a first error value Err1(*n, m*) and corrected error value Err2'(*n, m*) for each pixel PX. The first error value Err1(*n, m*) is calculated by the first error value calculator 36 in the process of sequentially performing gradation processing for each pixel PX. The corrected error value Err2'(*n, m*) is calculated by the corrected error value calculator 40.

The first pixel data calculator 30 calculates the first pixel data vd1_mod(n, m) according to the gradation of the input data vd_in(n, m). Specifically, the first pixel data vd1_mod (n, m) is calculated based on the input data vd_in(n, m) and the first error value Err1. Here, the first error value Err1 is stored in the storage part 41 with respect to each of those belonging to the same error diffusion block BL as the pixel PX(n, m) among a predetermined number of pixels adjacent to the pixel PX(n, m) in a predetermined direction in the pixel PX(n, m) (target pixel) corresponding to the input data vd_in. Details are described later while referring to FIG. 5 and FIG. 6. Here, when explained simply, the first pixel data calculator 30 limits the range referring to the first error value Err1 to [the one belonging to the same error diffusion block BL as the pixel PX(n, m)] thereby limiting the error diffusion range to within the error diffusion block BL. Therefore, the first pixel data vd1_mod(n, m) is calculated by limiting the error diffusion range to within the error diffusion block BL. Furthermore, the predetermined number of pixels adjacent in a predetermined direction indicates pixels surrounding the pixel of interest. For example, in an upper surface view, the lower left, lower, lower right, right adjacent, upper right, upper, upper left and left adjacent of the target pixel correspond to a predetermined number of pixels adjacent in a predetermined direction.

The second pixel data calculator 31 calculates the second pixel data vd2_mod(n, m) according to the gradation of the input data vd_in(n, m). Specifically, the second pixel data vd2_mod(n, m) is calculated based on the input data vd_in (n, m) and the corrected error value Err2'. Here, the corrected error value Err2' is stored in the storage part 41 for each of a predetermined number of pixels adjacent to the pixel PX(n, m) in the predetermined direction described above. Unlike the first pixel data calculator 30, the second pixel data calculator 31 does not limit the range referring to the corrected error value Err2' to [those belonging to the same error diffusion block BL as the pixel PX(n, m)]. Therefore, the second pixel data vd2_mod(n, m) is calculated without limiting the error diffusion range to within the error diffusion block BL.

The first quantized data calculator 32 calculates first quantized data LV1(*n, m*) obtained by quantizing the first pixel data vd1_mod(n, m) which is calculated by the first pixel data calculator 30. In addition, the first output pixel data calculator 33 calculates the first output pixel data vd1_out(n, m) by converting the first quantized data LV1(*n, m*) into 3 bit data. Details of these processes are explained later while referring to FIG. 10.

The second quantized data calculator 34 calculates second quantized data LV2(*n, m*) obtained by quantizing the second pixel data vd2_mod(n, m) which is calculated by the second pixel data calculator 31. In addition, the second output pixel data calculator 35 calculates the second output pixel data vd2_out(n, m) by converting the second quantized data LV2(*n, m*) into 3 bit data. Details of these processes are explained later while referring to FIG. 8. As is shown in FIG. 3, the second output pixel data vd2_out(n, m) which is calculated by the second output pixel data calculator 34 is the output data vd_out(n, m) of the gradation converter 10.

The first error value calculator 36 calculates a first error value Err1(*n, m*) based on the difference between the first pixel data vd1_mod(n, m) and the first quantized data LV1(*n, m*). Specifically, as is shown in the following equation (1), a value obtained by subtracting the first quantized data LV1(*n, m*) from the first pixel data vd1_mod(n, m) is calculated as the error value Err1(*n, m*).

$$Err1(n,m)=vd1_\mathrm{mod}(n,m)-LV1(n,m) \tag{1}$$

The first error value Err1(*n, m*) calculated by the first error value calculator 36 is supplied to the storage part 41 and is stored in the storage part 41 as the first error value Err1 corresponding to the pixel PX(n, m) while the error diffusion processor 11 carries out processing in the same frame.

The second error value calculator 37 calculates the second error value Err2(*n, m*) based on the difference between the second pixel data vd2_mod(n, m) and the second quantized data LV2(*n, m*). Specifically, as is shown in the following equation (2), a value obtained by subtracting the second quantized data LV2(*n, m*) from the second pixel data vd2_mod(n, m) is calculated as the error value Err2(*n, m*).

$$Err2(n,m)=vd2_\mathrm{mod}(n,m)-LV2(n,m) \tag{2}$$

The limit error value calculator 38 calculates a limit error value Err1_mux by limiting the first error value Err1 (*nm*) according to the values of the first quantized data LV1(*n, m*) and the second quantized data LV2(*n, m*). The limit error value Err1_mux is used later when the corrected error value calculator 40 calculates the corrected error value Err2'(*n, m*).

Details of the processing of the limit error value calculator 38 are explained later while referring to FIG. 11.

The judgment part 39 judges whether or not the pixel PX(n, m) is within a predetermined range from the boundary of a plurality of error diffusion blocks BL. Specifically, the judgment described above is caied out by performing a threshold judgment of a horizontal direction distance H and a vertical direction distance V shown in FIG. 2 (B). Details of the processing of the judgment part 39 are also explained later while referring to FIG. 11.

The corrected error value calculator 40 calculates a corrected error value Err2'(*n, m*) of the pixel PX(n, m) by correcting the second error value Err2(*n, m*) in a direction approaching the first error value Err1(*n, m*) according to the judgment result of the judgment part 39. More specifically, the corrected error value calculator 40 corrects the second error value Err2(*n, m*) in a direction approaching the first error value Err1 (*n, m*) in the case where a pixel PX(n, m) is within a predetermined range from the boundary of a plurality of error diffusion blocks BL based on the judgment result of the judgment part 39. As described above, the corrected error value calculator 40 calculates the corrected error value Err2'(*n, m*) of the pixel PX(n, m) which is the corrected second error value Err2(*n, m*). On the other hand, in the case when the judgment result of the judgment part 39 shows that the pixel PX(n, m) is not within the predetermined range from the boundary of a plurality of error diffusion blocks BL, the corrected error value calculator 40 sets the corrected error value Err1_mux calculated by the limit value calculator 38 as the corrected error value Err2'(*n, m*) of the pixel PX(n, m).

The corrected error value Err2'(*n, m*) calculated by the corrected error value calculator 40 is supplied to the storage part 41 and is stored in the storage part 41 as the corrected error value Err2' corresponding to a pixel PX(n, m) while the error diffusion processor 11 carries out processing n the same frame.

The output data vd_out(n, m) is calculated from the first pixel data vd1_mod(n, m) which is calculated based on the first error value Err1. The first error value Err1 changes discontinuously when it oversteps the boundary B. As described above, the boundary of an error diffusion block becomes apparent due to a discontinuous change of the first error value Err1. In the present embodiment, the output data vd_out(n, m) is generated from the second pixel data vd2_mod(n, m) which is calculated based on the corrected error value Err2'. Next, the corrected error value Err2' continuously changes including the boundary B. Therefore, according to the present embodiment, it is possible to suppress the boundary B of the error diffusion block BL becoming apparent.

Processing performed by each part in the error diffusion processor 11 is explained in more detail below while referring to the flow chart shown in FIG. 4.

Figure 4:
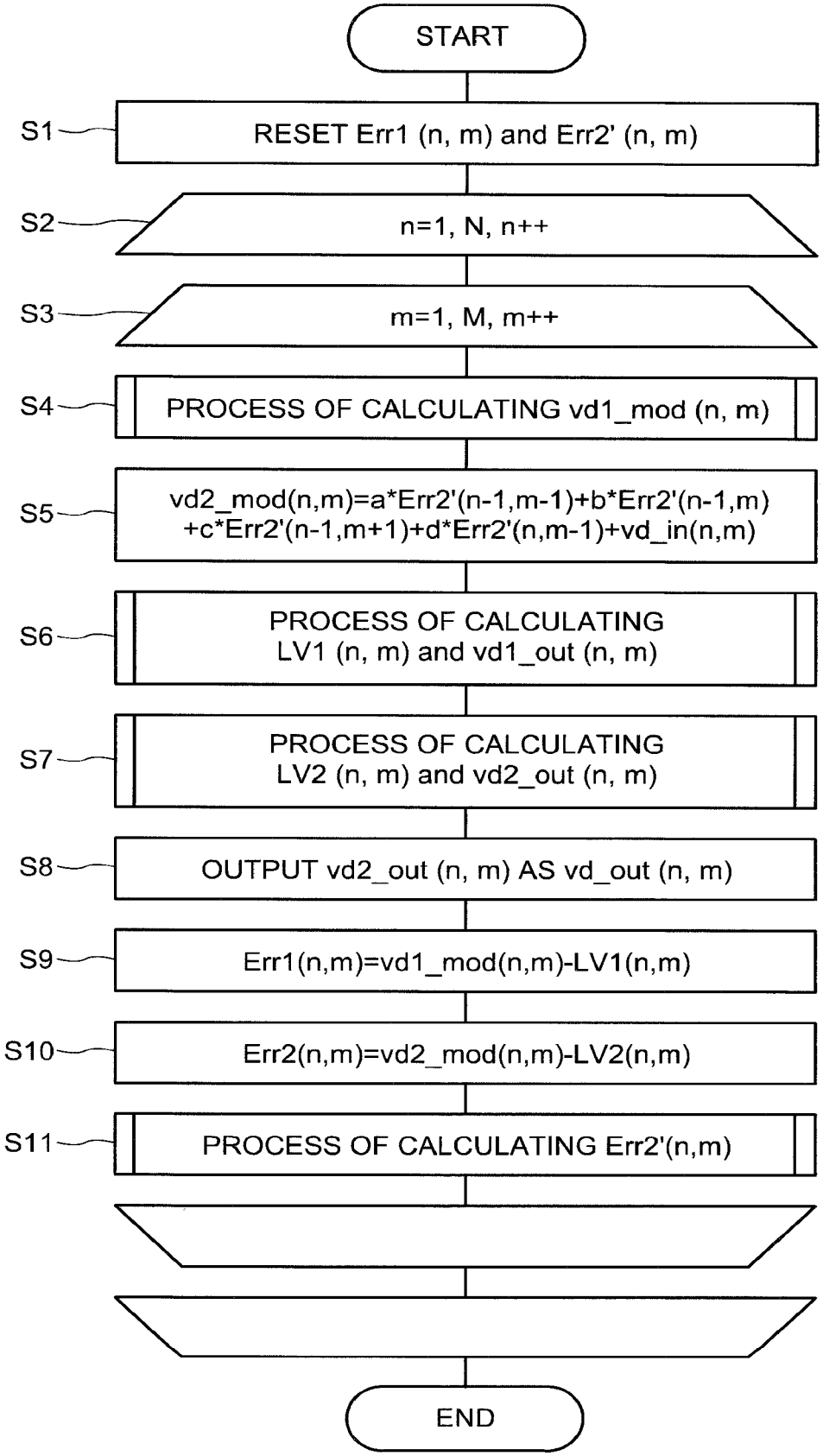
FIG. 4 is a flow diagram showing a process carried out by the error diffusion processor shown in FIG. 1.

FIG. 4 shows processing for one frame. As is shown in the diagram, when the processing of a new frame is started, first, the storage content of the storage part 41 is reset (step S1). Following this, the input data vd_in(n, m) is supplied from an upper device not shown in the diagram to the error diffusion processor 11. Here, in the input data vd_in(n, m), n is incremented one at a time from n=1 to n=N. In addition, for each n in the input data vd_in(n, m), m is incremented one at a time from m=1 to m=M (step S2 and S3 in FIG. 4). In this way, the error diffusion processor 11 repeats the processing of steps S4 to S11 explained below each time the input data vd_in(n, m) is supplied.

When the input data vd_in(n, m) is supplied, the first pixel data calculator 30 performs a process (process of calculating vd1_mod(n, m)) for calculating the first pixel data vd1_mod (n, m) (step S4).

Figure 5:
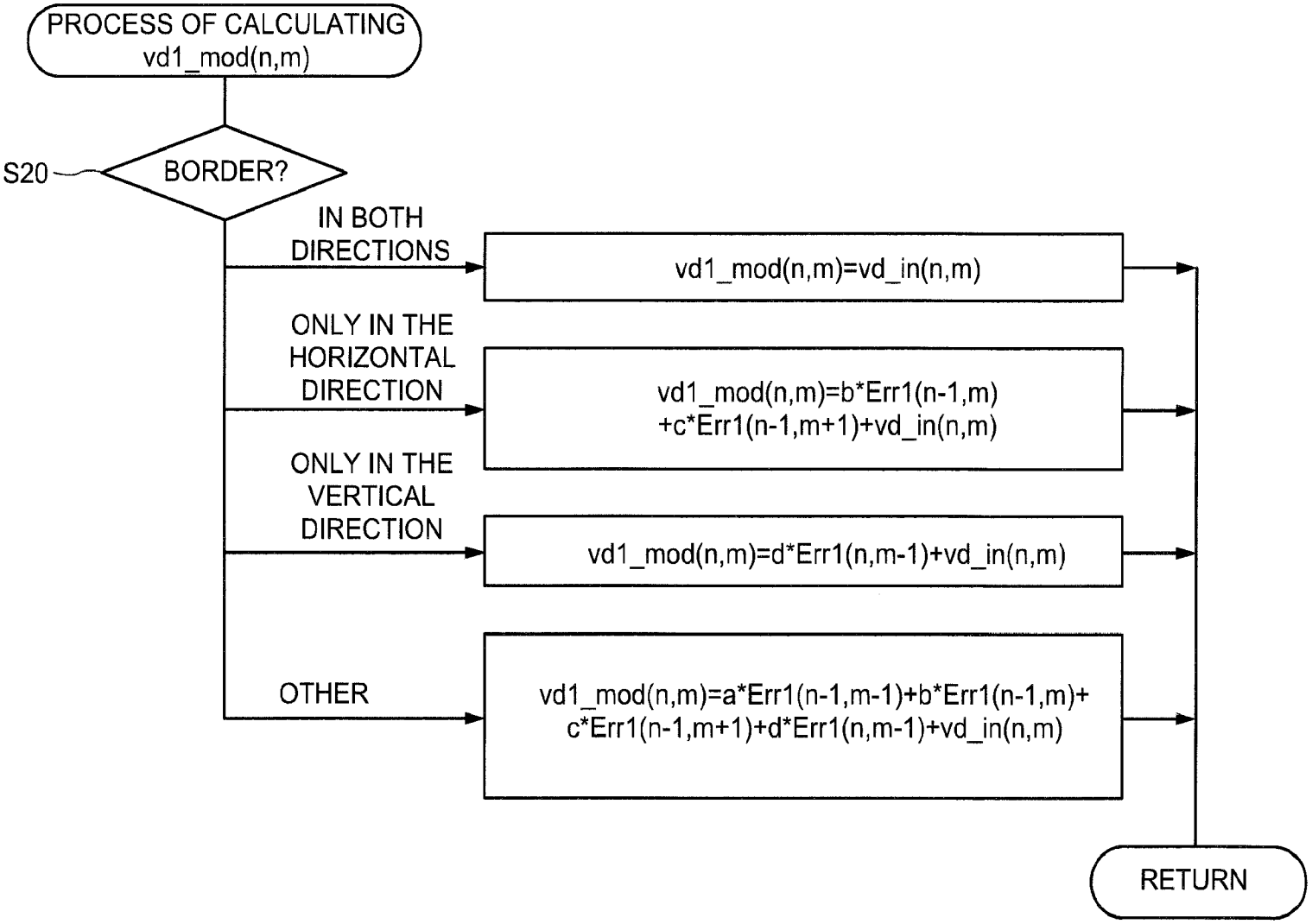
FIG. 5 is a flow diagram showing the details of a vd1_mod(n, m) calculation process shown in FIG. 4.

FIG. 5 is a flowchart showing the details of process of calculating vd1_mod(n, m). As is shown in the diagram, the first pixel data calculator 30 performs a process for judging the relationship between the pixel PX(n, m) and the boundary (step S20). Next, the first pixel data vd1_mod(n, m) is calculated by different equations in the case where the pixel PX(n, m) is located at the boundary in both a horizontal direction and vertical direction, in the case where the pixel PX(n, m) is located at the boundary only in the horizontal direction, in the case where the pixel PX(n, m) is located at the boundary only in the vertical direction, and in the case where the pixel PX(n, m) is not located at the boundary in either the horizontal direction or vertical direction. Furthermore, the calculation method of vd1_mod(n, m) of [in the case of only in the horizontal direction] in FIG. 5 may be the same equation as the calculation method of [in the case of both directions].

Figure 6A:
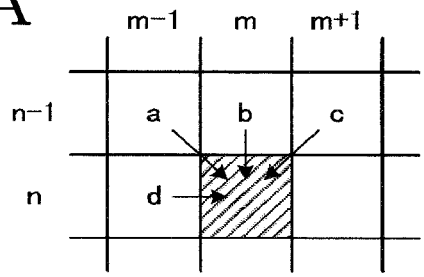
FIG. 6A is a diagram for explaining a vd1_mod(n, m) calculation process in each case shown in FIG. 5.

FIG. 6A to FIG. 6D are diagrams for explaining a calculation method of the first pixel data vd1_mod(n, m) in each case shown in FIG. 5. First, FIG. 6A shows a case where the pixel PX(n, m) is not located at a boundary in both the horizontal direction and the vertical direction. In this case, the first pixel data calculator 30 reads out the first error value Err1 from the storage part 41 for each of the four pixels PX including the pixel PX(n−1, m−1) adjacent to the pixel PX(n, m) in the upper left direction, the pixel PX(n−1, m) adjacent to the pixel PX(n, m) in the upper direction, the pixel PX(n−1, m+1) adjacent to the pixel PX(n, m) in the upper right direction, and the pixel PX(n, m−1) adjacent to the pixel PX(n, m) in the left direction. Next, as is shown in the following equation (3), the first pixel data vd1_mod(n, m) is calculated by adding the result of multiplying each of the read out four first error values Err1 by the coefficients a to d respectively, and then adding the input data vd_in(n, m) to this result.

$$vd1_\mathrm{mod}(n,m)=a\times Err1(n-1,m-1)+b\times Err1(n-1,m)+c\times Err1(n-1,m+1)+d\times Err1(n,m-1)+vd_in(n,m) \quad (3)$$

Here, the constants a, b, c, and d in the equation (3) are normalization coefficients of diffusion errors and are determined in advance so that a+b+c+d=1. There are a number of methods for selecting each specific value. For example, in the Floyd-Steinberg method, a=1/16, b=5/16, c=3/16, and d=7/16. In addition, in the Sierra Filter Lite method, a=0, b=1/4, c=1/4, and d=1/2. Which method is adopted may be decided considering the quality required for the image display system 1.

Figure 6B:
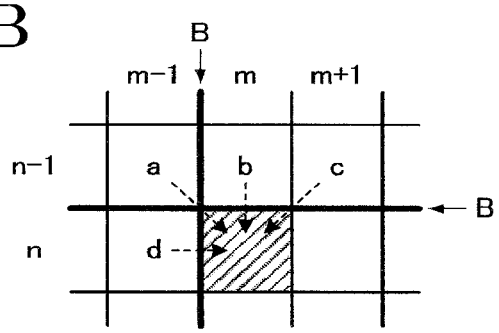
FIG. 6B is a diagram for explaining a vd1_mod(n, m) calculation process in each case shown in FIG. 5.

FIG. 6B shows a case in which a pixel PX(n, m) is located at a boundary in both the horizontal direction and the vertical direction. As described above, the first pixel data calculator 30 limits the range referring to the first error value Err1 to [those belonging to the same error diffusion block BL as the pixel PX(n, m)]. Therefore, in this case, the first pixel data vd1_mod(n, m) is calculated without referring to any of the four first error values Err1 referred to in the example of FIG. 6A. Specifically, as is shown in the following equation (4), the input data vd_in(n, m) is used without change as the first pixel data vd1_mod(n, m).

$$vd1_\mathrm{mod}(n,m)=vd_in(n,m) \quad (4)$$

Figure 6C:
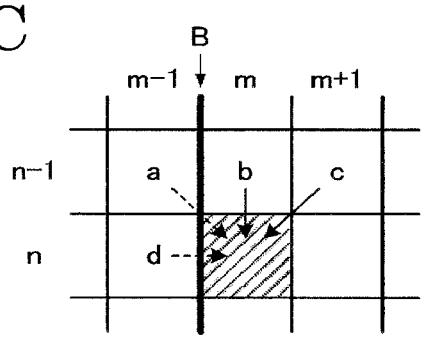
FIG. 6C is a diagram for explaining a vd1_mod(n, m) calculation process in each case shown in FIG. 5.

FIG. 6C shows a case where the pixel PX(n, m) is located at the boundary only in the vertical direction. In this case, the first pixel data calculator 30 calculates the first pixel data vd1_mod(n, m) without referring to the first error value Err1($n-1$, $m-1$) and the error value Err1($n$, $m-1$) corresponding to two pixels PX(n−1, m−1), PX(n, m−1) which do not belong to the same error diffusion block BL as the pixel PX(n, m) among the four first error values Err1 referred to in the example of FIG. 6A. Specifically, as is shown in the following equation (5), the product of the first error value Err1($n-1$, m) and the first error value Err1($n-1$, m+1) corresponding to the two pixels PX(n−1, m) and PX(n−1, m−1) which belong to the same error diffusion block BL as the pixel PX are each respectively multiplied the by the coefficients b and c described above, and the input data vd_in(n, m) is added to this result in order to calculate the first pixel data vd1_mod(n, m).

$$vd1_\mathrm{mod}(n,m)=b\times Err1(n-1,m)+c\times Err1(n-1,m+1)+vd_in(n,m) \quad (5)$$

Figure 6D:
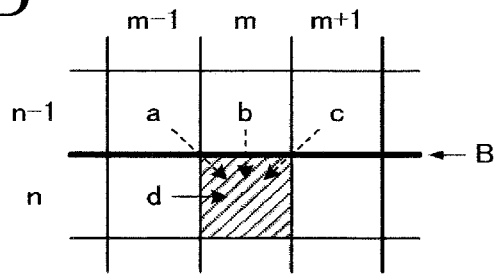
FIG. 6D is a diagram for explaining a vd1_mod(n, m) calculation process in each case shown in FIG. 5.

FIG. 6D shows a case where the pixel PX(n, m) is located at the boundary only in the horizontal direction. In this case, among the four first error values Err1 referred to in the example of FIG. 6A, the first pixel data calculator 30 calculates the first pixel data vd1_mod(n, m) without referring to the first error value Err1($n-1$, $m-1$), the first error value Err1($n-1$, m) and the first error value Err1($n-1$, m+1) corresponding to the three pixels PX(n−1, m−1), PX(n−1, m) and PX(n−1, m+1) which do not belong to the same error diffusion block BL as the pixel PX. Specifically, as is shown in the following equation (6), the product of multiplying the first error value Err1($n$, $m-1$) corresponding to the pixel PX(n, m−1) which belongs to the same error diffusion block BL as the pixel PX(n, m) by the input data vd_in(n, m) in order to calculate the first pixel data vd1_mod(n, m).

$$vd1_\mathrm{mod}(n,m)=d\times Err1(n,m-1)+vd_in(n,m) \quad (6)$$

In one embodiment of the present invention, the first pixel data vd1_mod(n, m) calculated by the first pixel data calculator 30 is calculated according to the gradation of the input data vd_in(n, m). Therefore, the coefficient to be multiplied by the first error value Err1 changes according to the gradation of the input data vd_in(n, m).

Figure 7:
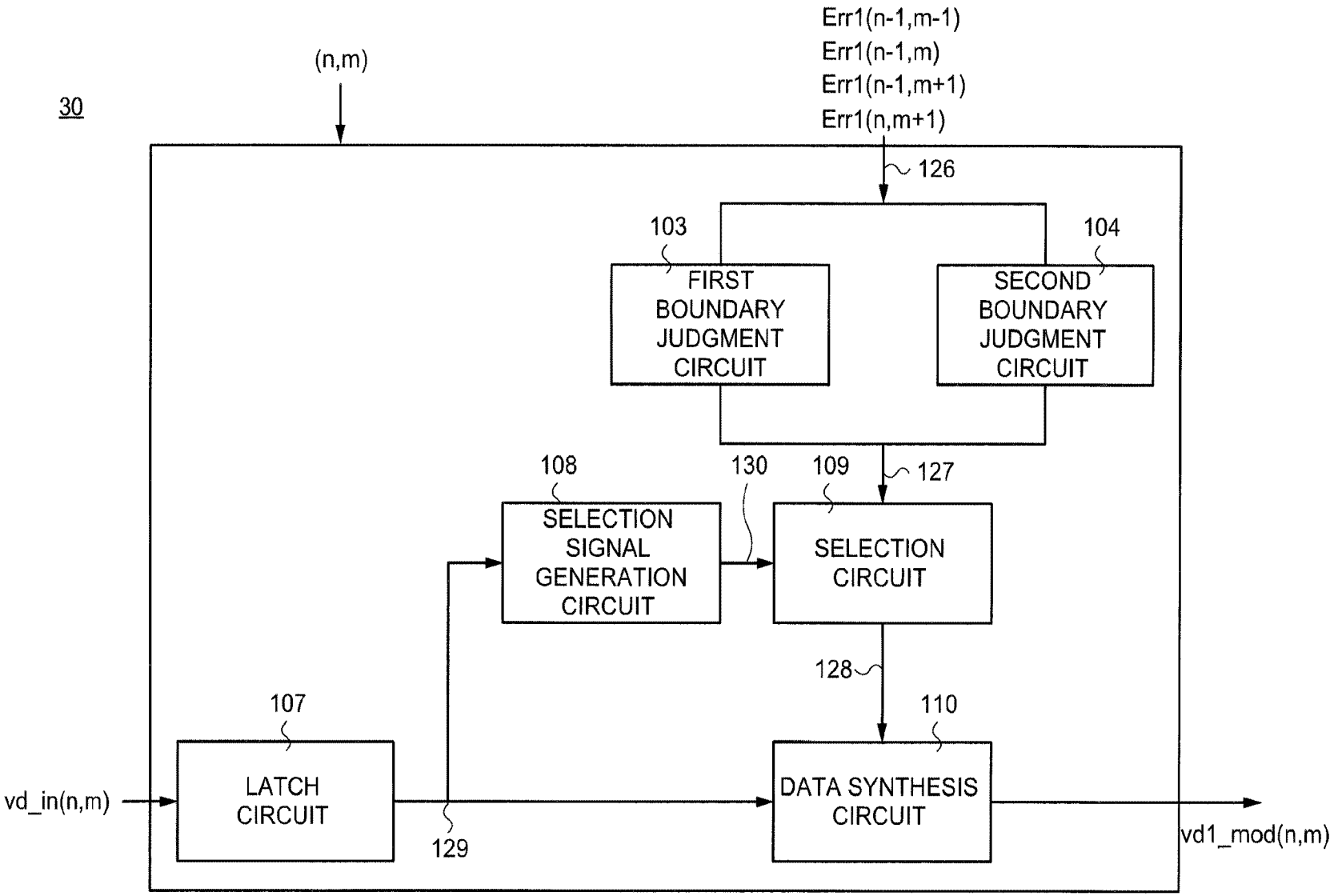
FIG. 7 is a schematic block diagram showing an example of a function block of the first pixel data calculator 30 shown in FIG. 3.

FIG. 7 is a schematic block diagram showing an example of a functional block of the first pixel data calculator 30 shown in FIG. 3. The first pixel data calculator 30 includes a first boundary judgment circuit 103, a second boundary judgment circuit 104, a latch circuit 107, a selection signal generation circuit 108, a selection circuit 109 and a data synthesis circuit 110. The first pixel data calculator 30 is input with the first error value Err1, the input data vd_in(n, m) and (n, m). (n, m) includes data indicating the coordinates of each pixel. In addition, the first pixel data calculator 30 outputs the first pixel data vd1_mod(n, m). In the case when the gradation of the input data vd_in(n, m) is less than 25 gradations, the first boundary judgment circuit 103 performs a process for judging the relationship between the pixel PX(n, m) and the boundary. In the case when the gradation of the input data vd_in(n, m) is equal to or more than 25 gradations, the second boundary judgment circuit 104 performs a process for judging the relationship between the pixel PX(n, m) and the boundary. Furthermore, (n, m) is input to each function block and may have a role of linking each data with the coordinates of each data.

The operation of the circuit for calculating the first pixel data vd1_mod(n, m) is explained. The first error value Err1, the input data vd_in(n, m) and (n, m) are input to the first pixel data calculator 30. The first error value Err1 is input to the first boundary judgment circuit 103 and the second boundary judgment circuit 104. The first boundary judgment circuit 103 and the second boundary judgment circuit 104 perform a process for judging the relationship between the pixel PX(n, m) and the boundary.

Specifically, in the first boundary judgment circuit 103 and the second boundary judgment circuit 104, the relationship between the pixel PX(n, m) and the boundary is judged and the first error value Err1 corresponding to a pixel in each direction surrounding the pixel of interest PX (n, m) is multiplied by the diffusion error normalization coefficient.

The input data vd_in(n, m) is input to the latch circuit 107. The latch circuit 107 stores the input data vd_in(n, m) and outputs the input data vd_in(n, m) for each input data vd_in(n, m) to be processed. Data 129 output from the latch circuit is input to the selection signal generation circuit 108. The selection signal generation circuit 108 judges whether or not the gradation of the data 129 outputted from the latch circuit is below 25 gradations, and outputs a selection signal 130.

Next, data 127 which is multiplied by the diffusion error normalization coefficient and the selection signal 130 are input to the selection circuit 109. According to the selection signal 130, the selection circuit 109 selects either the data obtained by multiplying the diffusion error normalization coefficient of less than 25 gradations or data obtained by multiplying the diffusion error normalization coefficient of 25 or more gradations and outputs the result. For example, in the case when the gradation of the data 129 output from the latch circuit is less than 25 gradations, the selection signal 130 is a signal for selecting data which is multiplied by a diffusion error normalization coefficient of less than 25 gradations, and the selection circuit 109 outputs data obtained by multiplying the diffusion error normalization coefficient of less than 25 gradations.

Next, the data 128 which is output from the selection circuit 109 and the data 129 which is output from the latch circuit are input to the data synthesis circuit 110. The data synthesis circuit 110 adds the data 128 output from the selection circuit 109 and the data 129 output from the latch circuit, and outputs the result. The data output from the data synthesis circuit 110 is the first pixel data vd1_mod(n, m). In the case where there are a plurality of first error values Err1 to be input, the first pixel data calculator 30 may add data obtained by multiplying by the diffusion error normalization coefficient according to each error value Err1, and then may add the data 129 output from the latch circuit. Details are explained while referring to FIG. 8 and FIG. 9 below.

Figure 8:
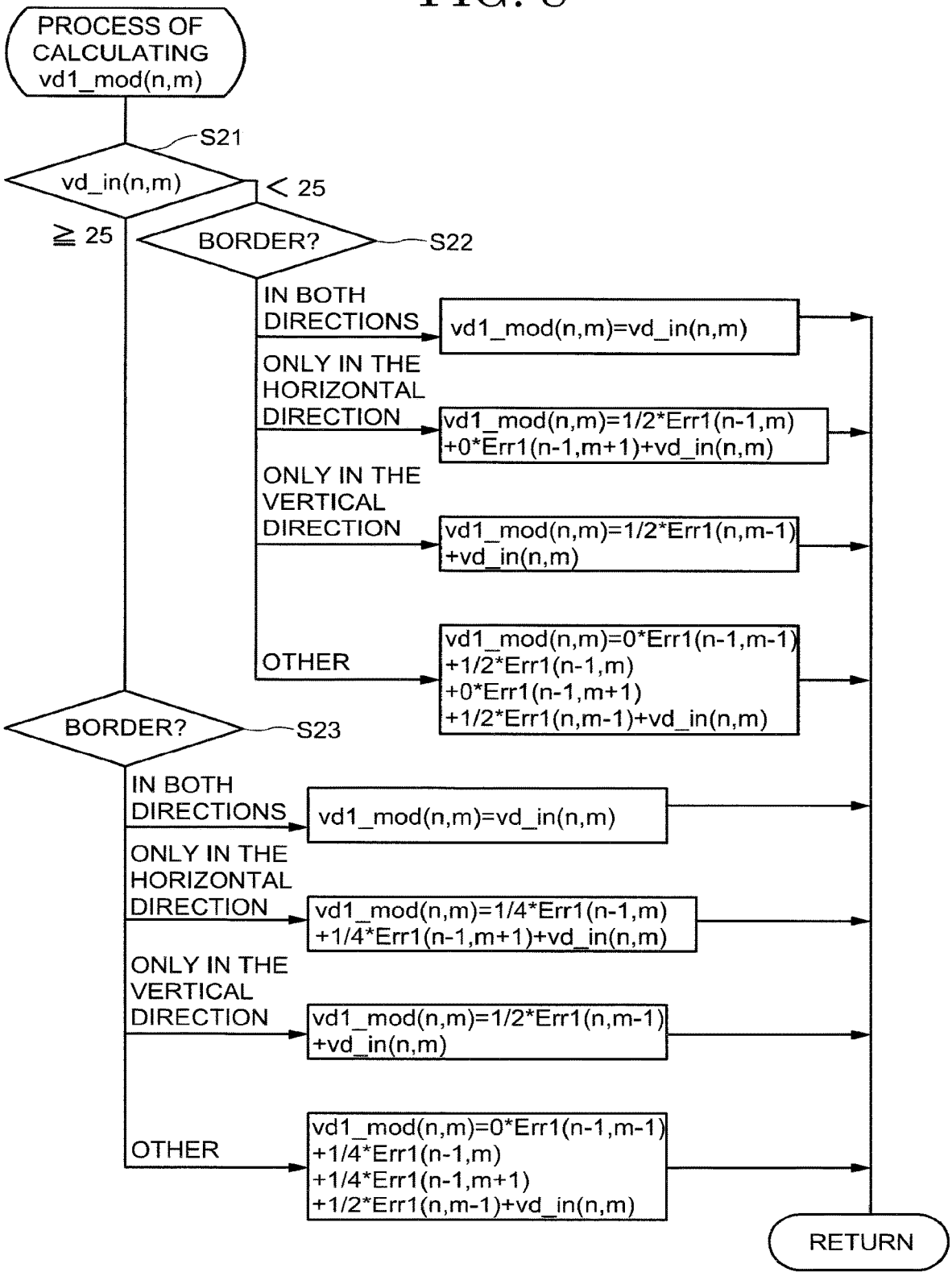
FIG. 8 is a flow diagram showing the details of a vd1_mod(n, m) calculation process according to a gradation of input data.

FIG. 8 is a flowchart showing details of the calculation process vd1_mod(n, m) according to the gradation of the input data vd_in(n, m). As is shown in FIG. 8, in the case when the gradation of the input data vd_in(n, m) is less than 25 gradations, the first pixel data calculator 30 carries out a process of judging the relationship between the pixel PX(n, m) and the boundary by the first boundary judgment circuit 103 according to step S22. In the case when the gradation of the input data vd_in(n, m) is equal to or more than 25 gradations, the first pixel data calculator 30 performs a process for judging the relationship between the pixel PX(n, m) and the boundary by the second boundary judgment circuit 104 according to step S23. Next, in each step, first pixel data vd1_mod(n, m) is calculated by different equations in the case where the pixel PX(n, m) is located at the boundary in both of the horizontal direction and the vertical direction, in the case where the pixel PX(n, m) is located at the boundary only in the horizontal direction, in the case where the pixel PX(n, m) is located at the boundary only in the vertical direction and in the case where the pixel PX(n, m) is not located at the boundary in either the horizontal direction or the vertical direction. Furthermore, the calculation method of vd1_mod(n, m) in [the case of only in the horizontal direction] in FIG. 8 may be the same equation as the calculation method of [in the case of both directions].

Figure 9A:
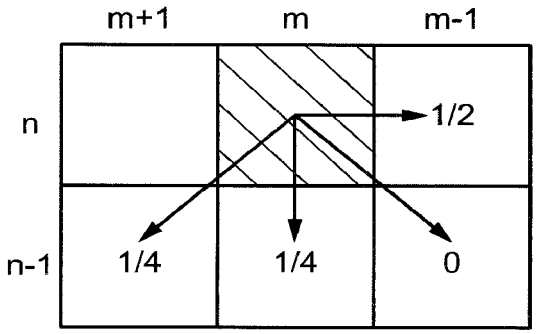
FIG. 9A is a diagram for explaining a vd1_mod(n, m) calculation process according to a gradation of input data shown in FIG. 8.

Here, in the case when the gradation of the input data vd_in(n, m) is equal to or more than 25 gradations, the constants a, b, c, and d which express the diffusion error normalization coefficient shown in equation (3) are respectively a is 0, b is ¼, c is ¼, and d is ½. FIG. 9A is a diagram showing a specific example of the process of calculating vd1_mod(n, m) shown in FIG. 8. FIG. 9A shows a specific example of a process of calculating vd1_mod(n, m) in the case when the gradation of the input data vd_in(n, m) is equal to or more than 25 gradations. As is shown in an upper surface view of FIG. 9A, a pixel in the horizontal direction with respect to the target pixel PX(n, m) is multiplied by the diffusion error normalization coefficient d=½. Similarly, a pixel in the lower right direction with respect to the target pixel PX(n, m) is multiplied by the diffusion error normalization coefficient a=0. Similarly, a pixel in the vertical direction with respect to the target pixel PX(n, m) is multiplied by the diffusion error normalization coefficient b=¼. Similarly, a pixel in the lower left direction with respect to the target pixel PX(n, m) is multiplied by the diffusion error normalization coefficient c=¼.

In the case where the pixel PX(n, m) is located at the block boundary of the error diffusion block BL in both the horizontal direction and the vertical direction, vd1_mod(n, m) is the equation (4) mentioned previously.

In the case where the pixel PX(n, m) is located at the block boundary of the error diffusion block BL only in the vertical direction, vd1_mod(n, m) is given by the following equation (7).

$$\text{vd1_mod}(n, m) = \frac{1}{4}Err1(n-1, m) + \frac{1}{4}Err1(n-1, m+1) + \text{vd_in}(n, m) \tag{7}$$

In the case where the pixel PX(n, m) is located at the block boundary of the error diffusion block BL only in the horizontal direction, vd1_mod(n, m) is given by the equation (8).

$$\text{vd1_mod}(n, m) = \frac{1}{2}Err1(n, m-1) + \text{vd_in}(n, m) \tag{8}$$

In the case where the pixel PX(n, m) is not located at the block boundary of the error diffusion block BL in either the horizontal or vertical directions, vd1_mod(n, m) is given by the equation (9).

$$\text{vd1_mod}(n, m) = \frac{1}{4}Err1(n-1, m) + \frac{1}{4}Err1(n-1, m+1) + \frac{1}{2}Err1(n, m-1) + \text{vd_in}(n, m) \tag{9}$$

Figure 9B:
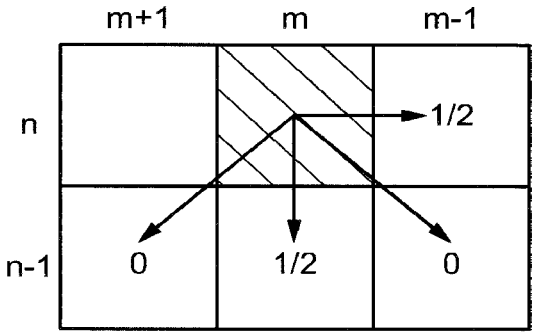
FIG. 9B is a diagram for explaining a vd1_mod(n, m) calculation process according to a gradation of input data shown in FIG. 8.

On the other hand, in the case when the gradation of the input data vd_in(n, m) is less than 25 gradations, the constants a, b, c, and d which express the diffusion error normalization coefficients shown in equation (3) are a is 0, b is ½, c is 0, and d is ½. FIG. 9B is a diagram showing a specific example of the process of calculating vd1_mod(n, m) shown in FIG. 8. FIG. 9B shows a specific example of the process of calculating vd1_mod(n, m) in the case when the gradation of the input data vd_in(n, m) is less than 25 gradations. As is shown in an upper surface view of FIG. 9B, a pixel in the horizontal direction with respect to the target pixel PX(n, m) is multiplied by the diffusion error normalization coefficient d=½. Similarly, a pixel in the lower right direction with respect to the target pixel PX(n, m) is multiplied by the diffusion error normalization coefficient a=0. Similarly, a pixel in the vertical direction with respect to the target pixel PX(n, m) is multiplied by the diffusion error normalization coefficient b=½. Similarly, a pixel in the lower left direction with respect to the target pixel PX(n, m) is multiplied by the diffusion error normalization coefficient c=0.

In the case where the pixel PX(n, m) is located at the block boundary of the error diffusion block BL in both the horizontal direction and the vertical direction, vd1_mod(n, m) is given by the equation (4) described above.

In the case where the pixel PX(n, m) is located at the block boundary of the error diffusion block BL only in the vertical direction, vd1_mod(n, m) is given by the following equation (10).

$$\text{vd1_mod}(n, m) = \frac{1}{2}Err1(n-1, m) + 0 \times Err1(n-1, m+1) + \text{vd_in}(n, m) \tag{10}$$

In the case where the pixel PX(n, m) is located at the block boundary of the error diffusion block BL only in the horizontal direction, vd1_mod(n, m) is given by the equation (11).

$$\text{vd1_mod}(n, m) = \frac{1}{2}Err1(n, m-1) + \text{vd_in}(n, m) \tag{11}$$

In the case where the pixel PX(n, m) is not located at the block boundary of the error diffusion block BL in either the horizontal or vertical direction, vd1_mod(n, m) is given by the equation (12).

$$\text{vd1_mod}(n, m) = \frac{1}{2}Err1(n-1, m+1) + \frac{1}{2}Err1(n, m-1) + \text{vd_in}(n, m) \tag{12}$$

Returning to FIG. 4, after calculating the first pixel data vd1_mod(n, m) in step S4, a process is carried out by the second pixel data calculator 31 for calculating the second pixel data vd2_mod(n, m) (step S5). More specifically, first the second pixel data calculator 31 first reads out the corrected error value Err2' from the storage part 41 with respect to each of the four pixels PX, namely the pixel data PX(n−1, m−1) adjacent to the pixel PX(n, m) in the upper left direction, the pixel PX(n−1, m) adjacent to the pixel PX(n, m) in the upper direction, the pixel PX(n−1, m+1) adjacent to the pixel PX(n, m) in the upper right direction and the pixel PX(n, m−1) adjacent to the pixel PX(n, m) in the left direction. Next as is shown in the following equation (7), the product of the four corrected error values Err2' which are read out and multiplied by the coefficients a to d respectively is added. Furthermore, the second pixel data vd2_mod(n, m) is calculated by adding the input data vd_in(n, m) to this result. The equation (13) replaces the first pixel data vd1_mod(n, m) in the equation (3) with the second pixel data vd2_mod(n, m), and furthermore, replaces the first error value Err1 with the corrected error value Err2'.

$$vd2_mod(n,m)=\alpha\times Err2'(n-1,m-1)+b\times Err2'(n-1,m)+c\times Err2'(n-1,m+1)+d\times Err2'(n,m-1)+vd_in(n,m) \quad (13)$$

In addition, even in the case where a process is carried out by the second pixel data calculator 31 for calculating the second pixel data vd2_mod(n, m), it is the same as in the case where a process is carried out by the first pixel data calculator 30 for calculating the first pixel data vd1_mod(n, m). That is, also in the case where the second pixel data calculator 31 calculates the second pixel data vd2_mod(n, m), whether the gradation of the input data vd_in(n, m) is 25 gradations or more or less than 25 gradations, the constants a, b, c, and d that represent the diffusion error normalization coefficient are changed. In the explanation of FIG. 7, the operation of the circuit of the second pixel data calculator 31 can be similarly explained by respectively replacing the first pixel data calculator 30 with the second pixel data calculator 31, and the first error value Err1 with the corrected error value Err2'. Therefore, a detailed explanation thereof is omitted.

In the corrected error value Err2', in the case when the gradation of the input data vd_in(n, m) is equal to or more than 25 gradations, the constants a, b, c and d expressing the diffusion error normalization coefficient shown in equation (13) are a is 0, b is ¼, c is ¼ and d is ½. In the case when the gradation of the input data vd_in(n, m) is 25 gradations or more, the second pixel data calculator 31 performs processing by the second boundary judgment circuit 104.

In the case where the pixel PX(n, m) is located at the block boundary of the error diffusion block BL in both the horizontal direction and the vertical direction, vd2_mod(n, m) is given as the equation (4) mentioned above.

In the case where the pixel PX(n, m) is located at the block boundary of the error diffusion block BL only in the vertical direction, vd2_mod(n, m) becomes the following equation (14).

$$\text{vd2_mod}(n, m) = \frac{1}{4}Err2'(n-1, m) + \frac{1}{4}Err2'(n-1, m+1) + \text{vd_in}(n, m) \quad (14)$$

In the case where the pixel PX(n, m) is located at the block boundary of the error diffusion block BL only in the horizontal direction, vd2_mod(n, m) becomes the following equation (15).

$$\text{vd2_mod}(n, m) = \frac{1}{2}Err2'(n, m-1) + \text{vd_in}(n, m) \quad (15)$$

In the case where the pixel PX(n, m) is not located at the block boundary of the error diffusion block BL in either the horizontal or vertical direction, vd2_mod(n, m) becomes the following equation (16).

$$\text{vd2_mod}(n, m) = \frac{1}{4}Err2'(n-1, m) + \frac{1}{4}Err2'(n-1, m+1) + \frac{1}{2}Err2'(n, m-1) + \text{vd_in}(n, m) \quad (16)$$

On the other hand, in the case when the gradation of the input data vd_in(n, m) is less than 25 gradations, the constants a, b, c, and d which express the diffusion error normalization coefficients shown in equation (13) are a is 0, b is ½, c is 0, and d is ½. In the case when the gradation of the input data vd_in(n, m) is less than 25 gradations, the second pixel data calculator 31 performs processing by the first boundary judgment circuit 103.

In the case where the pixel PX(n, m) is located at the block boundary of the error diffusion block BL in both the horizontal direction and the vertical direction, vd2_mod(n, m) is the equation (4) mentioned above.

In the case where the pixel PX(n, m) is located at the block boundary of the error diffusion block BL only in the vertical direction, vd2_mod(n, m) is given by the following equation (17).

$$\text{vd2_mod}(n, m) = \frac{1}{2}Err2'(n-1, m) + 0\times Err2'(n-1, m+1) + \text{vd_in}(n, m) \quad (17)$$

In the case where the pixel PX(n, m) is located at the block boundary of the error diffusion block BL only in the horizontal direction, vd2_mod(n, m) is given by the following equation (18).

$$\text{vd2_mod}(n, m) = \frac{1}{2}Err2'(n, m-1) + \text{vd_in}(n, m) \quad (18)$$

In the case where the pixel PX(n, m) is not located at the block boundary of the error diffusion block BL in either the horizontal or vertical direction, vd2_mod(n, m) is given by the following equation (19).

$$\text{vd2_mod}(n, m) = \frac{1}{2}Err2'(n-1, m+1) + \frac{1}{2}Err2'(n, m-1) + \text{vd_in}(n, m) \quad (19)$$

FIG. 9A and FIG. 9B are diagrams showing specific examples of a process of calculating vd2_mod(n, m). Since the explanation of FIG. 9A and FIG. 9B is the same as the explanation made in the process of calculating vd1_mod(n, m), an explanation here is omitted. Even in the case when the error diffusion range is not limited to within the error diffusion block BL, by performing gradation processing according to the error diffusion method in which the constants a, b, c, and d which express the diffusion error normalization coefficient are changed according to the gradation of the input data vd_in(n, m) in the process of calculating vd2_mod(n, m), it is possible to distribute errors according to the gradation of the pixel PX(n, m) to the pixel adjacent to the pixel PX(n, m). Therefore, in the image displayed on the image display system, it is possible to reduce the difference in gradation between pixels. That is, it is possible to suppress a drop in image quality in an image displayed on the image display system.

Next, calculation of first quantized data LV1(*n, m*) is carried out by the first quantized data calculator 32 and calculation of first output pixel data vd1_out(n, m) is carried out by the first output pixel data calculator 33 (process of calculating [LV1(*n, m*), vd1_out(n, m)] of step S6). In addition, calculation of second quantized data LV2(*n, m*) is carried out by the second quantized data calculator 34 and calculation of the second output pixel data vd2_out(n, m) is carried out by the second output pixel data calculator 35 (process of calculating [LV2(*n, m*), vd2_out(n, m)] of step S7).

Figure 10:
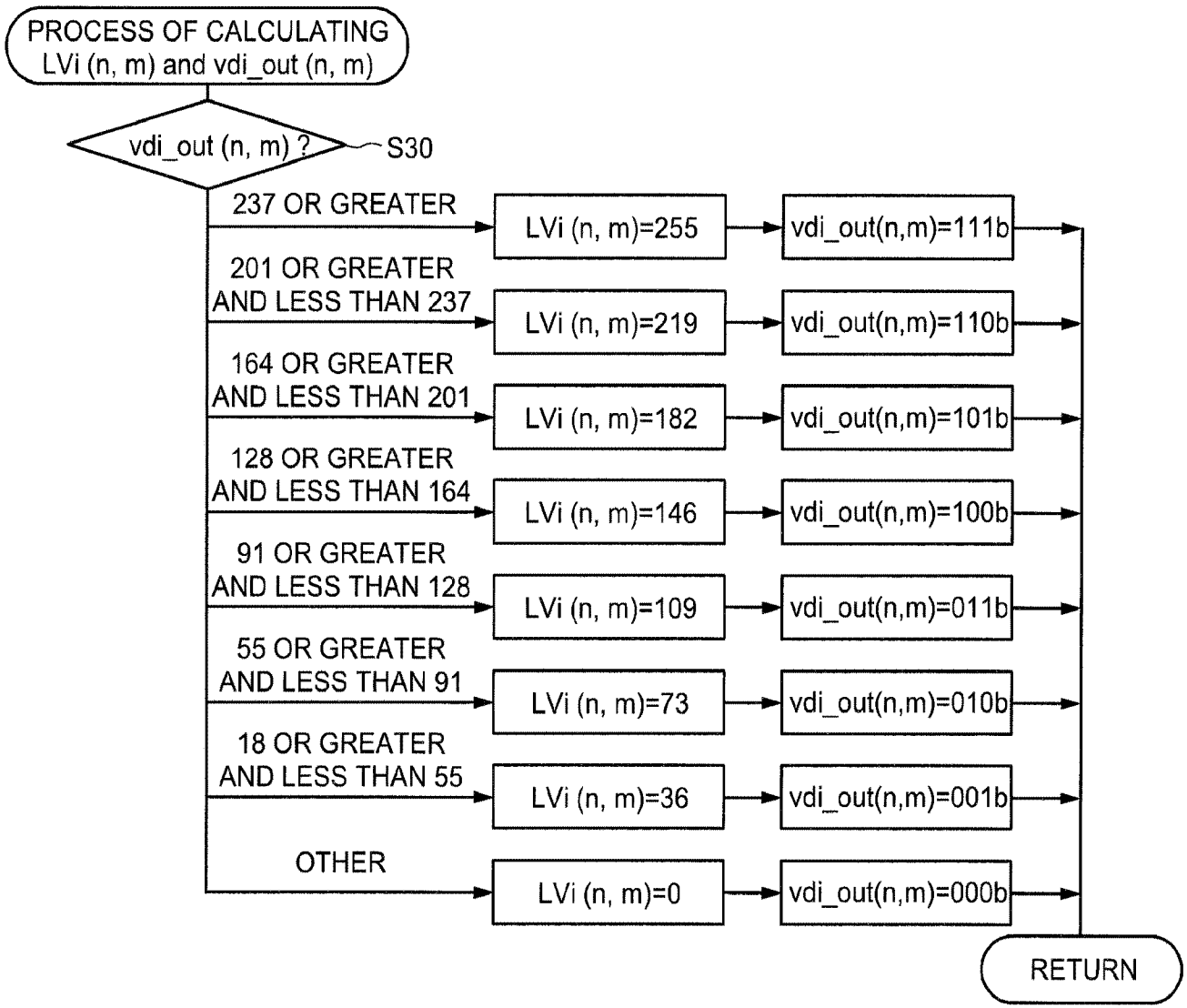
FIG. 10 is a flow diagram showing the details of a LV1(*n, m*), vd1_out(n, m) calculation process and a LV2(*n, m*), vd2_out(n, m) calculation process shown in FIG. 4.

FIG. 10 is a flowchart showing details of a process of calculating LV1(*n, m*), vd1_out(n, m) and a process of calculating LV2(*n, m*), vd2_out(n, m). [i] shown in FIG. 10 is a variable representing [1] or [2]. In the following description, although an explanation is given with attention focused on a process in the case where i=1, that is, the process of calculating LV1(*n, m*), vd1_out(n, m), the same is true for the process of calculating LV2(*n, m*), vd2_out(n, m).

First, the range of the value of the first pixel data vd1_mod(n, m) is judged by the first quantized data calculator 32 (step S22). In the example of FIG. 10, the values of the first pixel data vd1_mod(n, m) are judged to belong to any one of [237 or more], [201 or more and less than 237], [164 or more and less than 201], [128 or more and less than 164], [91 or more and less than 128], [55 or more and less than 91], [18 or more and less than 55], and [other (less than 18)]. Furthermore, In FIG. 10, although the range to be judged uses eight ranges, this is because the number which can be expressed by the number of bits 3 of the first output pixel data vd1_out(n, m) corresponds to eight types from [0] to [7]. Depending on the number of bits of the first output pixel data vd1_out(n, m), the range to be judged may be set narrower. In addition, the range to be judged may be set less narrow. The narrower the range to be judged, the higher the definition of an image which can be obtained in the image displayed on the image display system.

The first quantized data calculator 32 calculates the first quantized data LV1(*n, m*) based on the judgement result of step S30. In the example of FIG. 10, for example, in the case when the value of the first pixel data vd1_mod(n, m) is [237 or more], the first quantized data calculator 32 determines the value of the first quantized data LV1(*n, m*) as [255]. Similarly, in the case when the value of the first pixel data vd1_mod(n, m) is [201 or more and less than 237], the first quantized data calculator 32 determines the value of the first quantized data LV1(*n, m*) as [219]. In the case when the value of the first pixel data vd1_mod(n, m) is [164 or more and less than 201], the first quantized data calculator 32 determines the value of the first quantized data LV1(*n, m*) as [182]. In the case when the value of the first pixel data vd1_mod(n, m) is [128 or more and less than 164], the first quantized data calculator 32 determines the value of the first quantized data LV1(*n, m*) as [146]. In the case when the value of the first pixel data vd1_mod(n, m) is [91 or more and less than 128], the first quantized data calculator 32 determines the value of the first quantized data LV1(*n, m*) as [109]. In the case when the value of the first pixel data vd1_mod(n, m) is [55 or more and less than 91], the first quantized data calculator 32 determines the value of the first quantized data LV1(*n, m*) as [73]. In the case when the value of the first pixel data vd1_mod(n, m) is [other (less than 18)], the first quantized data calculator 32 determines the value of the first quantized data LV1(*n, m*) as [0].

When the first quantized data LV1(*n, m*) is determined in this way, the first output pixel data calculator 33 calculates the value of the first output pixel data vd1_out(n, m), which is 3 bit data. More specifically, in the case when the value of the first quantized data LV1(*n, m*) is [255], for example, the first output pixel data calculator 33 sets the first output pixel data vd1_out(n, m) as [111b]. Similarly, in the case when the value of the first quantized data LV1(*n, m*) is [219, the value of the first output pixel data vd1_out(n, m) is set as [110 b]. In the case when the value of the first quantized data LV1(*n, m*) is [182, the value of the first output pixel data vd1_out(n, m) is set as [101b]. In the case when the value of the first quantized data LV1(*n, m*) is [146], the value of the first output pixel data vd1_out(n, m) is set as [100b]. In the case when the value of the first quantized data LV1(*n, m*) is [109], the value of the first output pixel data vd1_out(n, m) is set as [011b]. In the case when the value of the first quantized data LV1(*n, m*) is [73], the value of the first output pixel data vd1_out(n, m) is set as [010b]. In the case when the value of the first quantized data LV1(*n, m*) is [36], the value of the first output pixel data vd1_out(n, m) is set as [001b]. In the case when the value of the first quantized data LV1(*n, m*) is [0], the value of the first output pixel data vd1_out(n, m) is set as [000b].

Returning to FIG. 4, after the first quantized data LV1(*n, m*), the first output pixel data vd1_out(n, m), the second quantized data LV2(*n, m*), and the second output pixel data vd2_out(n, m) are calculated in step S6 and step S7, the second output pixel data vd2_out(n, m) is output as the output data vd_out(n, m) of the gradation converter 10 (step S8). The output output data vd_out(n, m) is supplied to the display part 20 shown in FIG. 1 and is used for displaying (depicting) an image on the display surface 21.

Next, calculation of the first error value Err1(*n, m*) by the first error value calculator 36 and calculation of the second error value Err2(*n, m*) by the second error value calculator 37 are carried out (step S9 and step S10). Specific methods of these calculations are as shown in the equations (1) and (2) described above. As described above, the first error value Err1(*n, m*) calculated by the first error value calculator 36 is stored in the storage part 41 shown in FIG. 3 as the first error value Err1 corresponding to a pixel PX(n, m), and is used when calculating the first pixel data vd1_mod with respect to other pixels PX adjacent to the pixel PX(n, m) (specifically the four pixels PX(n, m+1), PX(n+1, m−1), PX(n−1, m) and PX(n+1, m+1)).

Here, the first pixel data vd1_mod and the first quantized data LV1 which are used when calculating the first error value Err1 are limited to within the error diffusion block BL (that is, as explained while referring to FIG. 5, calculating without referring to the first error value of the pixel PX which does not belong to the same error diffusion block BL of a pixel PX(n, m)). Therefore, the first error value Err1 is also limited to within the error diffusion block BL. On the other hand, the second pixel data vd2_mod and the second quantized data LV2 which are used when calculating the second error value Err2 are not to limited within the error diffusion block BL (that is, as explained while referring to FIG. 5, calculating without consideration of the error diffusion block BL). Therefore, the second error value Err2 is also not limited to within the error diffusion block BL.

Finally, a process is carried out for calculating the corrected error value Err2'(*n, m*) by the limit error value calculator 38, the judgement part 39, and the corrected error value calculator 40 ([Err2'(*n, m*) calculation process] in step S11).

Figure 11:
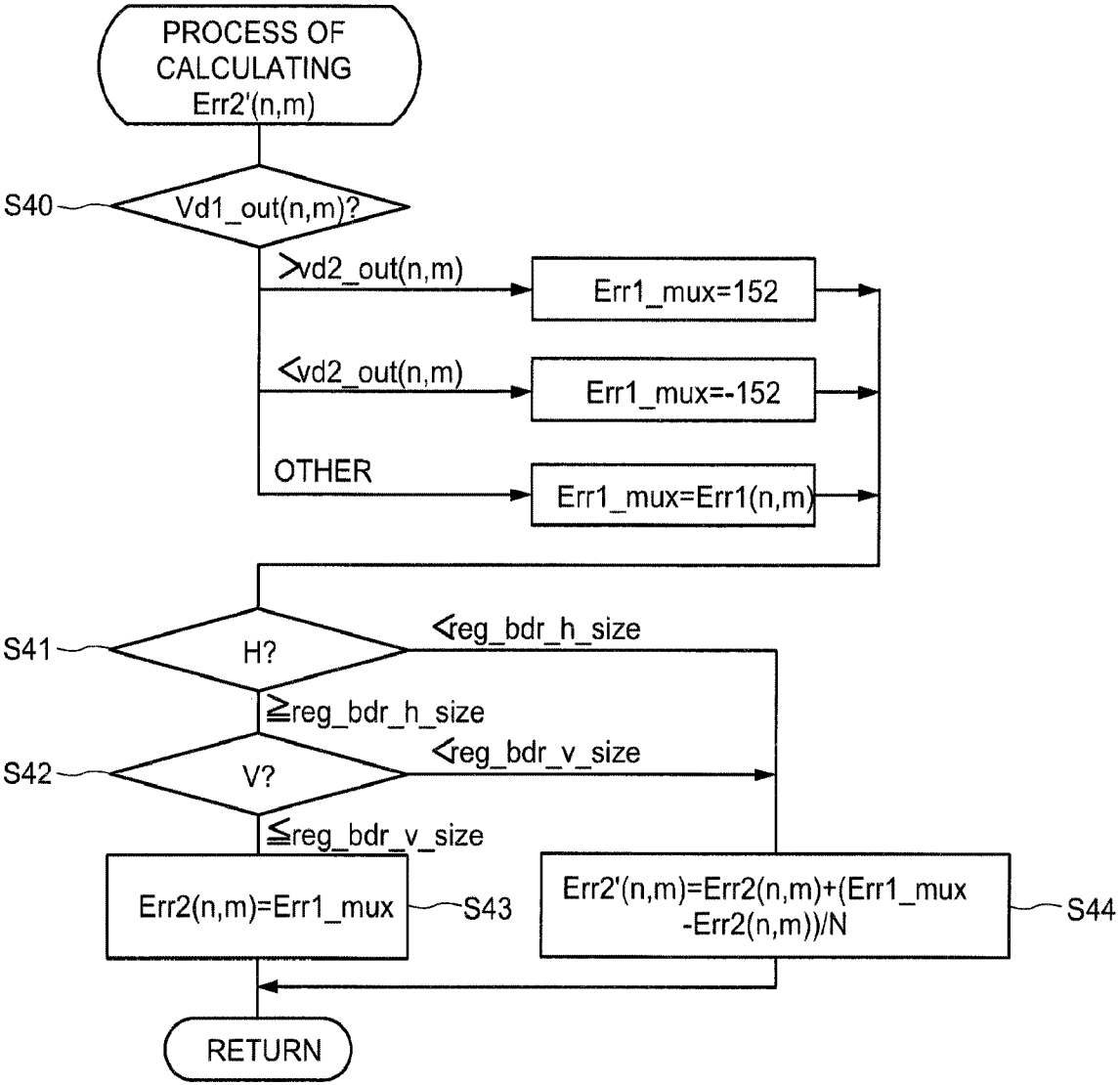
FIG. 11 is a flow diagram showing the details of an Err2'(*n, m*) calculation process shown in FIG. 4.

FIG. 11 is a flowchart showing the details of the Err2'(*n, m*) calculation process. In this process, first, the limit error value calculator 38 judges the relationship between the first output pixel data vd1_out(n, m) and the second output pixel data vd2_out(n, m) (step S40). Furthermore, this process is also the same when judging the relationship between the first quantized data LV1(*n, m*) and the second quantized data LV2(*n, m*).

In the case when the first output pixel data vd1_out(n, m) is larger than the second output pixel data vd2_out(n, m), the limit error value calculator 38 sets the numerical value [152] to the limit error value Err1_mux. On the other hand, in the case when the first output pixel data vd1_out(n, m) is smaller than the second output pixel data vd2_out(n, m), the limit error value calculator 38 sets the numerical value [−152] to the limit error value Err1_mux. In other cases, that is, in the case when the first output pixel data vd1_out(n, m) and the second output pixel data vd2_out(n, m) are equal, the limit error value calculator 38 sets the first error value Err1(*n, m*) to the limit error value Err1_mux.

Next, the judgment part 39 makes a threshold value judgement of a horizontal direction distance H and vertical direction distance V shown in FIG. 2B. As shown in FIG. 2B, the horizontal direction distance H is the distance from the left end of the error diffusion block BL including the pixel PX(n, m) to the pixel PX(n, m) and is expressed by the number of pixels. Similarly, the vertical direction distance V is the distance from the upper end of the error diffusion block BL including the pixel PX(n, m) to the pixel PX(n, m) and is expressed by the number of pixels. For example, the horizontal direction distance H and the vertical direction distance V for the pixel PX shown by oblique line hatching to the lower left in FIG. 2B are both [5]. Furthermore, in the above explanation, the standard for calculating the horizontal distance H and the vertical distance V are [left end] and [upper end] respectively, and since the scanning direction of the image display system 1 (supply direction of the input data vd_in(n, m)) is from left to right and from top to bottom. In the case when the scanning direction is different, the standard for calculating the horizontal distance H and the vertical distance V naturally changes.

The judgment part 39 stores in advance the threshold value reg_bdr_h_size as the threshold value of the horizontal direction distance H. In addition, the threshold value reg_bdr_v_size is stored in advance as a threshold value of the vertical direction distance V. Next, by comparing these with the horizontal direction distance H and the vertical direction distance V, the threshold value judgment described above is carried out (step S41 and step S42).

In the case when the judgment part 39 judges that the horizontal direction distance H is smaller than the threshold value reg_bdr_h_size or the vertical direction distance V is smaller than the threshold value reg_bdr_v_size, that is, in the case when the pixel PX(n, m) is located within a predetermined range from the upper end or the left end of the error diffusion block BL, the corrected error value calculator 40 corrects the second error value Err2(*n, m*) in the direction approaching the first error value Err1(*n, m*), and thereby the corrected error value Err2'(*n, m*) of the pixel PX(n, m) is calculated. Specifically, as is shown in the following equation (20), a value based on a value obtained by subtracting the second error value Err2(*n, m*) from the limit error value Err1_mux (more specifically, a value obtained by dividing a value obtained by subtracting the second error value Err2(*n, m*) from the limit error value Err1_mux by a predetermined number N) is added to the second error value Err2(*n, m*) to calculate the corrected error value Err2'(*n, m*) (step S44). Furthermore, [16] is preferred as a specific value of the predetermined number N.

$$Err2'(n, m) = Err2(n, m) + \frac{\text{Err1_mux} - Err2(n, m)}{N} \tag{20}$$

In addition, instead of the reciprocal of the predetermined number N described above, a function of the number of pixels from the boundary of the error diffusion block or a function of n and m may be used. In addition, the second term of equation (20) may be a nonlinear function of Err2(*n, m*) and Err1_mux.

On the other hand, in the case when the judgment part 39 judges that the horizontal direction distance H is equal to or larger than the threshold value reg_bdr_h_size and the vertical direction distance V is equal to or larger than the threshold value reg_bdr_v_size, that is, in the case when the pixel PX(n, m) is not located within the predetermined range from the upper end or the left end of the error diffusion block BL, the corrected error value calculator 40 sets the limit error value Err1_mux as the corrected error value Err2'(*n, m*) (step S43).

$$Err2'(n,m)=Err1_mux \tag{21}$$

As described above, the corrected error value Err2'(*n, m*) calculated by the corrected error value calculator 40 is stored in the storage part 41 as the corrected error value Err2' corresponding to the pixel PX(n, m). Next, it is used when calculating the second pixel data vd2_mod with respect to other pixels adjacent to the pixel PX(n, m) (specifically, the four pixels such as PX(n, m+1), PX(n+1, m−1), PX(n+1, m) and PX(n+1, m+1)).

Returning to FIG. 4, by the processes explained so far, the processing for one piece of input data vd_in(n, m) is completed. When processing of all the input data vd_in(n, m) is completed, processing of one frame by the error diffusion process part 11 is completed. Following this, although not shown in the diagram, processing of the next frame is similarly executed.

As explained above, according to the image display system 1 of the present embodiment, the output data vd_out (n, m) is generated from the second pixel data vd2_mod(n, m) which is calculated based on the corrected error value Err2'. Next, since the corrected error value calculator 40 calculates the corrected error value Err2' by the process described above, the corrected error value Err2' continuously changes including the boundary B. Therefore, according to the image display system 1 of the present embodiment, it is possible to suppress conspicuousness of the boundary of the error diffusion block.

Although the preferred embodiment according to one embodiment of the present invention was explained above, the present invention is not limited to this embodiment, and the present invention can be applied in various modes without departing from the concept thereof.

For example, in the embodiment described above, the structure according to one embodiment of the present invention was explained on the premise of using the display part 20 in a monochrome display. As described above, the structure according to one embodiment of the present invention can also be applied to the case of using the display part 20 in a color display. In this case, input data vd_in(n, m) is input to the gradation converter 10 for each color (for example, red (R), green (G), blue (B), and white (W)). Therefore, in the structure according to one embodiment of the present invention, in the case of using the display part 20 in a color display, the processes described above may be performed for each color.

In the case of using the display part 20 in a color display, the arrangement of the error diffusion blocks BL may be the same regardless of color or may be different for each color. An arrangement that can obtain an optimum display result may be appropriately selected.

In addition, in the embodiment described above, although each individual error diffusion block BL is formed by a rectangle configured by four sides parallel to each in a horizontal direction and a vertical direction, it is also possible to configure individual error diffusion blocks BL using other shapes. The shape of each individual error diffusion block BL is arbitrary and may be appropriately selected so as to obtain an optimum display result.

In addition, the input data vd_in input to the error diffusion process part 11 in the embodiment described above may be dithered by a dithering process part not shown in the diagram of the gradation converter 10. For example, the dithering process part sets the originally 8 bit image data to 6 bits by dithering 8, and data of the 6 bit image is converted to 4 bits by dithering 6 and the result may be input to the error diffusion process part 11 as the input data vd_in.

In addition, an effect of one embodiment of the present invention is that it is particularly effective in the case where video is embedded in a region of one par in a screen and the other regions are still images. Furthermore, when the error diffusion process part 11 performs processing, it judges whether the input data vd_in to be displayed indicates that video is embedded in a region of one part in the screen and the other regions are still images, and processing may be changed according to the result. Specifically, in the case when the judgment result is affirmative (YES), the processing described in the present embodiment is performed. On the other hand, in the case when the judgement result is negative (NO), for example, the first pixel data vd1_mod(n, m) which is calculated in step S4 of FIG. 4 is output as the output data vd_out(n, m), and the processes in step S5, step S7, step S8, step S10 and S11 may be skipped. It is judged whether or not the input data vd_in to be displayed indicates that video is embedded in a region of one part in the screen and the other regions are still images, and by changing the processing according to the result, it is possible to perform efficient image processing and display an image on the image display system.

As explained above, by performing a gradation process using the error diffusion method in which the constants a, b, c, and d representing the diffusion error normalization coefficient are changed by the gradation of the input data vd_in(n, m), it is possible to continuously change the block boundary of an error diffusion block BL. Therefore, the block boundary of the error diffusion block BL is not apparent, and it is possible to provide a high quality image. By utilizing one embodiment of the present invention, it is possible to make the block boundary of the error diffusion block BL which is particularly apparent on the low gradation side less apparent.

Second Embodiment

In the present embodiment, another image processing device according to one embodiment of the present invention is explained. Furthermore, explanations of the same structure as in the first embodiment may be omitted.

Figure 12:
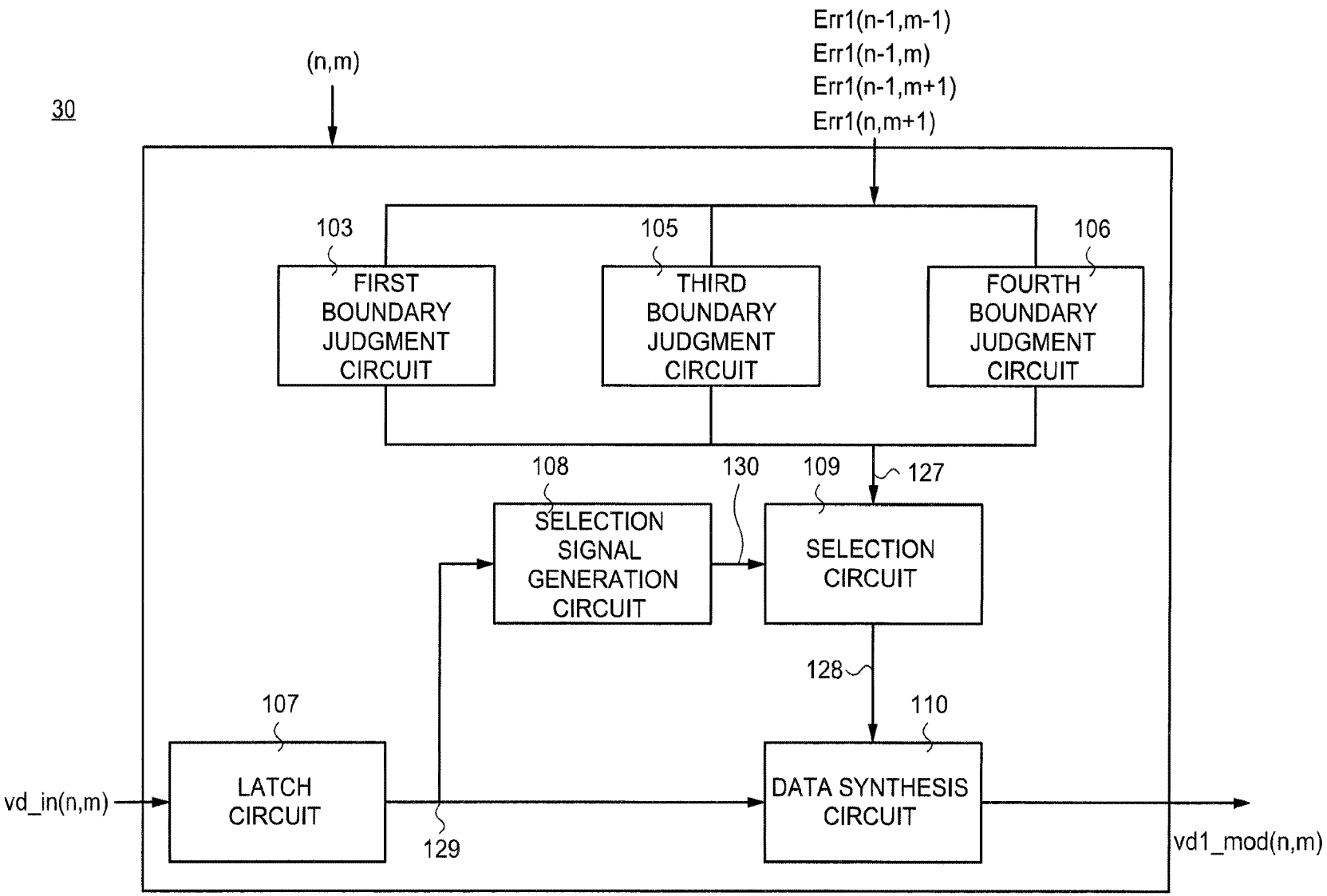
FIG. 12 is a schematic block diagram showing an example of another function block of the first pixel data calculator 30 shown in FIG. 3 and FIG. 7.

FIG. 12 is a schematic block diagram showing another example of a functional block of the first pixel data calculator 30 shown in FIG. 3 and FIG. 7. Except that the second boundary judgment circuit 104 is deleted and the third boundary judgment circuit 105 and the fourth boundary judgment circuit 106 are added, the rest is the same as FIG. 7. In the present embodiment, in the case when the gradation of the input data vd_in(n, m) is less than 25 gradations, the first boundary judgment circuit 103 performs a process for judging the relationship between the pixel PX(n, m) and the boundary. In the case where the gradation of the input data vd_in(n, m) is more than 25 gradations and less than 65 gradations, the third boundary judgment circuit 105 performs a process for judging the relationship between the pixel PX(n, m) and the boundary. In the case when the gradation of the input data vd_in(n, m) is 65 gradations or more, the fourth boundary judgment circuit 106 performs a process for judging the relationship between the pixel PX(n, m) and the boundary. Except for the contents described above, the explanation is similar to that in FIG. 7 and therefore an explanation here is omitted.

Figure 13:
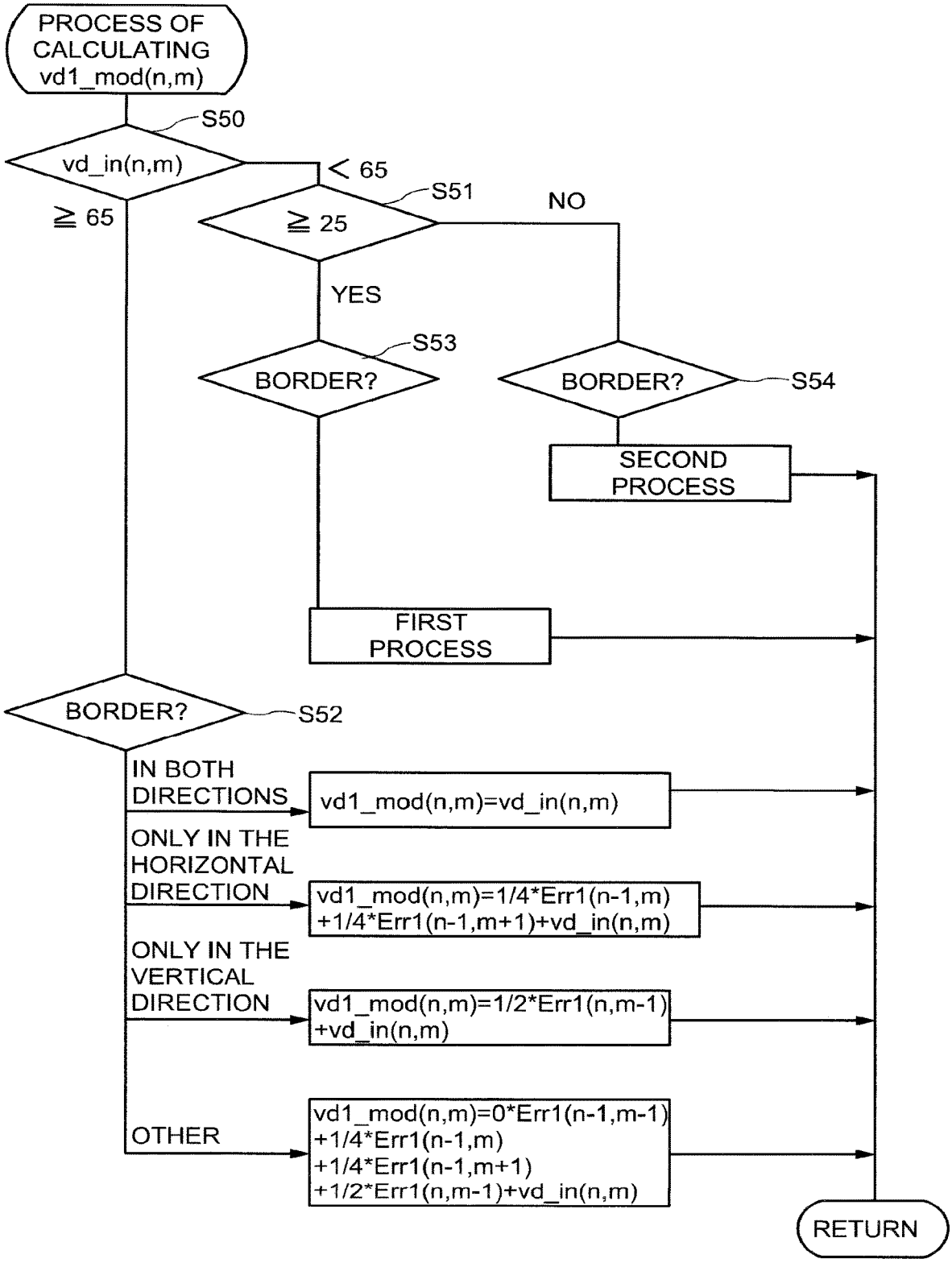
FIG. 13 is a flow diagram showing the details of another embodiment of a vd1_mod(n, m) calculation process according to a gradation of input data shown in FIG. 8.

FIG. 13 is a flowchart showing details of another embodiment of a vd1_mod(n, m) calculation process according to the gradation of the input data shown in FIG. 8.

In FIG. 13, according to step S50, the process of the first pixel data calculator 30 are different in the case where the gradation of the input data vd_in(n, m) is 65 or more and when it is less than 65. In the case when the gradation of the input data vd_in(n, m) is 65 or more, the fourth boundary judgment circuit 106 performs a process for judging the relationship between the pixel PX(n, m) and the boundary according to step 52. In the case when the gradation of the input data vd_in(n, m) is less than 65, the first pixel data calculator 30 performs a process for judging the relationship between the pixel PX(n, m) and the boundary according to step S51. In step S51, in the case when the gradation of the input data vd_in(n, m) is 25 or more, the third boundary judgment circuit 105 performs a process (first process) for judging the relationship between the pixel PX(n, m) and the boundary according to step S53. In step S51, in the case when the gradation of the input data vd_in(n, m) is less than 25, the first boundary judgment circuit 103 performs a process (second process) for judging the relationship between the pixel PX(n, m) and the boundary according to step S54. Next, in each step, calculation of the first pixel data vd1_mod(n, m) is performed using different equations in the case where the pixel PX(n, m) is located at the boundary in both of the horizontal direction and the vertical direction, in the case where the pixel PX(n, m) is located at the boundary only in the horizontal direction, in the case where the pixel PX(n, m) is located at the boundary only in the vertical direction, and in the case where the pixel PX is not located at the boundary in either the horizontal direction or the vertical direction. Furthermore, the calculation method of vd1_mod(n, m) of [in the case of only in the horizontal direction] in FIG. 8 may be the same equation as the calculation method of [in the case of both directions].

Specifically, in step 52, in the case when the gradation of the input data vd_in(n, m) is 65 gradations or more, the constants a, b, c and d which represent the diffusion error normalization coefficient shown in the equation (3) are a is 0, b is ¼, c is ¼, and d is ½. Since step 52 performs the same processes as step S23 which was explained using FIG. 8, an explanation here is omitted.

Figure 14:
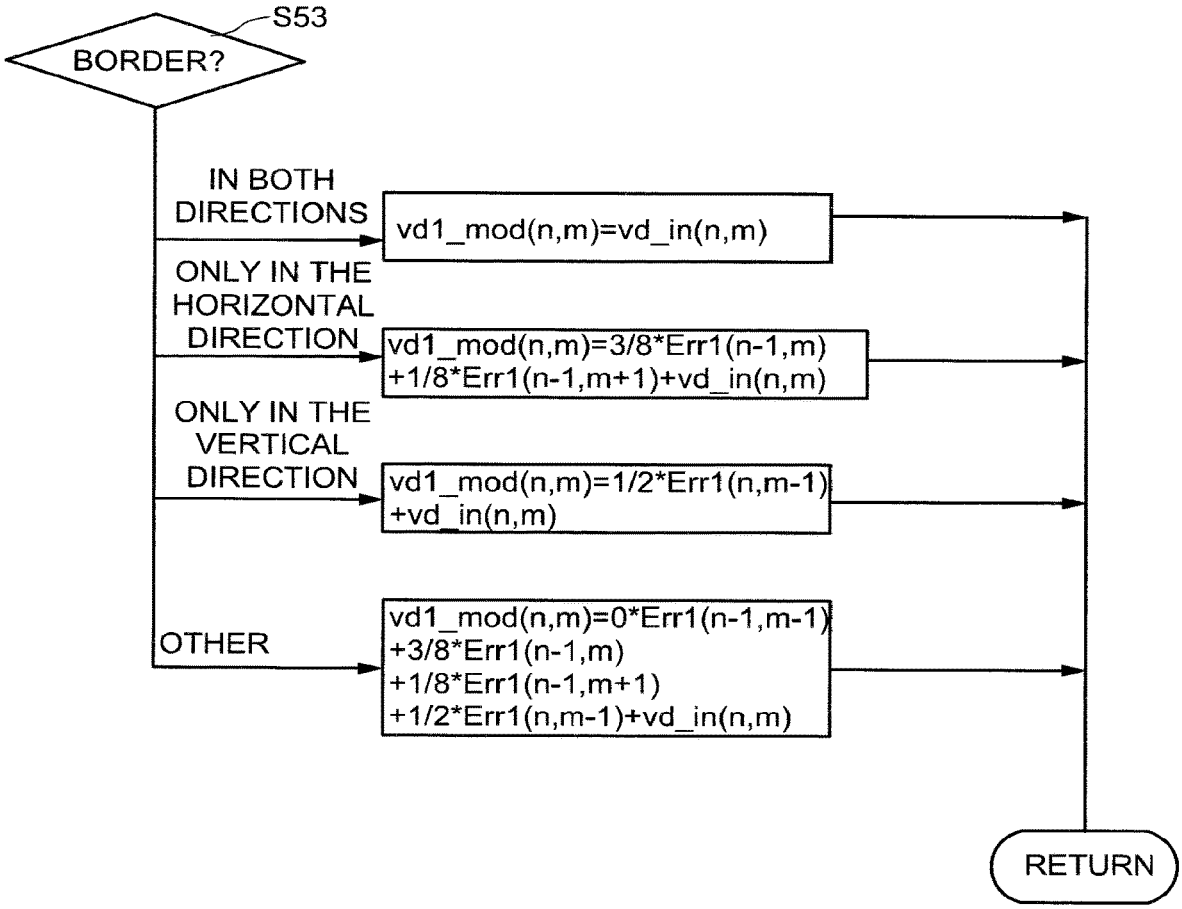
FIG. 14 is a flow diagram showing the details of another embodiment of a vd1_mod(n, m) calculation process according to a gradation of input data shown in FIG. 13.

In step 53 in the case when the gradation of the input data vd_in(n, m) is less than 65 and 25 or more, processing is performed according to the flowchart shown in FIG. 14. In step 53, the constants a, b, c, and d representing the diffusion error normalization coefficient shown in equation (3) are a is 0, b is ⅜, c is ⅛ and d is ½.

In the case where the pixel PX(n, m) is located at the block boundary of the error diffusion block BL in both the horizontal direction and the vertical direction, vd1_mod(n, m) is given as the equation (4) described above.

In the case where the pixel PX(n, m) is located positioned at the block boundary of the error diffusion block BL only in the vertical direction, vd1_mod(n, m) is given by the following equation (22).

$$\text{vd1_mod}(n, m) = \frac{3}{8}Err1(n-1, m) + \frac{1}{8}Err1(n-1, m+1) + \text{vd_in}(n, m) \tag{22}$$

In the case where the pixel PX(n, m) is located at the block boundary of the error diffusion block BL only in the horizontal direction, vd1_mod(n, m) is given by the equation (23).

$$\text{vd1_mod}(n, m) = \frac{1}{2}Err1(n, m-1) + \text{vd_in}(n, m) \tag{23}$$

In the case where the pixel PX(n, m) is not located at the block boundary of the error diffusion block BL in either the horizontal direction or the vertical direction, vd1_mod(n, m) is expressed by the equation (24).

$$\text{vd1_mod}(n, m) = \frac{3}{8}Err1(n-1, m) + \frac{1}{8}Err1(n-1, m+1) + \frac{1}{2}Err1(n, m-1) + \text{vd_in}(n, m) \tag{24}$$

Figure 15:
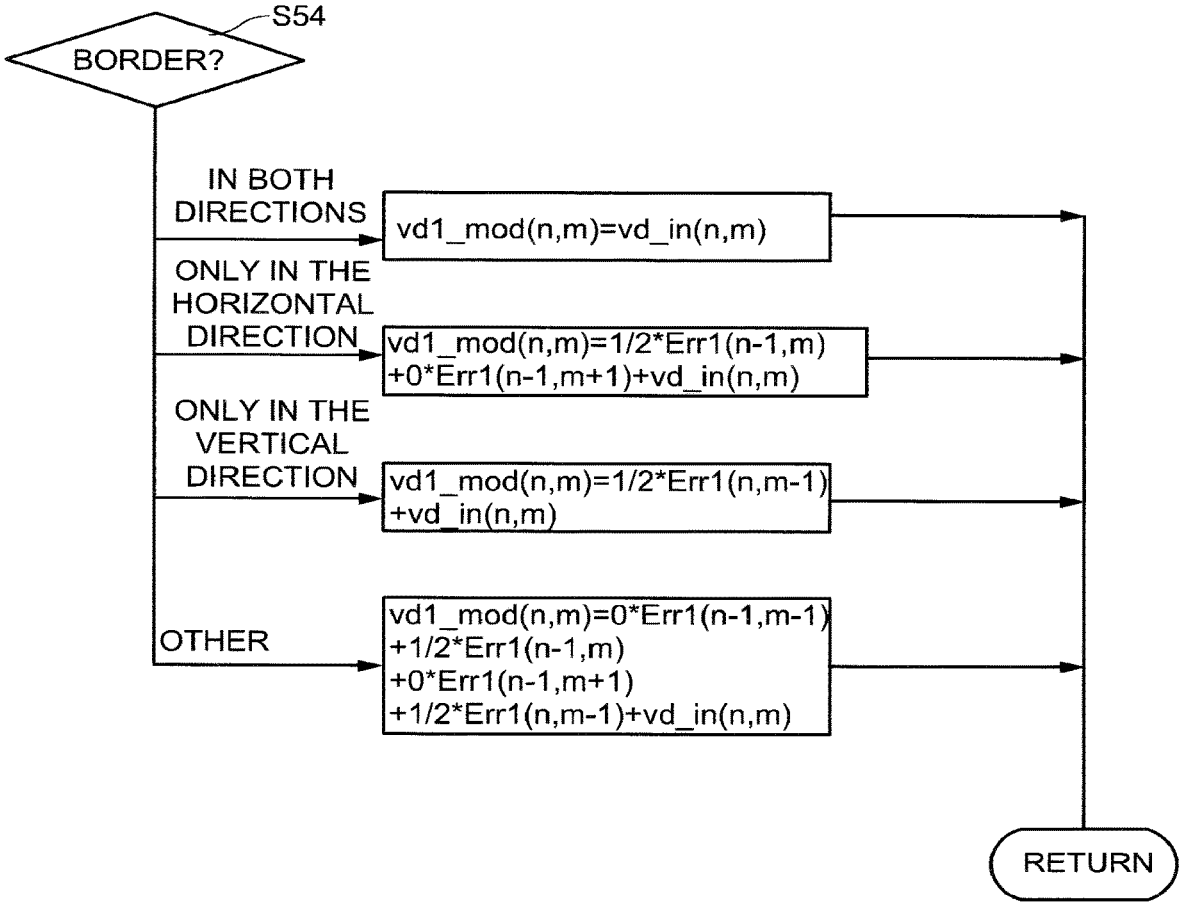
FIG. 15 is a flow diagram showing the details of another embodiment of a vd1_mod(n, m) calculation process according to a gradation of input data shown in FIG. 13.

On the other hand, in step S54 in the case when the gradation of the input data vd_in(n, m) is less than 25 gradations, processing is performed according to the flow chart shown in FIG. 15. In step S54, the constants a, b, c, and d representing the diffusion error normalization coefficient shown in equation (3) are a is 0, b is ½, c is 0 and d is ½. Since step S54 performs the same processing as step S22 explained in FIG. 8, an explanation here is omitted.

In addition, even in the case where the second pixel data calculator 31 performs a process for calculating the second pixel data vd2_mod(n, m), similar to the case where first pixel data calculator 30 performs a process for calculating the first pixel data vd1_mod(n, m), the constants a, b, c, and d representing the diffusion error normalization coefficient are changed between 65 gradations or more, 25 gradations or more and less than 65 gradations, and less than 25 gradations. The second pixel data calculator 31 includes a second pixel data calculator 31A (not shown in the diagram) in the case where the gradation of the input data vd_in(n, m) is less than 25 gradations, a second pixel data calculator 31C (not shown in the diagram) in the case where the gradation of the input data vd_in(n, m) is 25 gradations or more and less than 65 gradations, and a second pixel data calculator 31D (not shown in the diagram) in the case where the gradation of the input data vd_in(n, m) is 65 gradations or more. In the case where a process is performed for calculating the second pixel data vd2_mod(n, m), in the calculation method of the second pixel data vd2_mod(n, m), the first pixel data vd1_mod(n, m) is replaced by the second pixel data vd2_mod(n, m) in each equation in step S23 explained in FIG. 8, in step S53 explained in FIG. 14, and step S54 explained in FIG. 15, and furthermore, the first error value Err1 is replaced with the corrected error value Err2'.

Figure 16A:
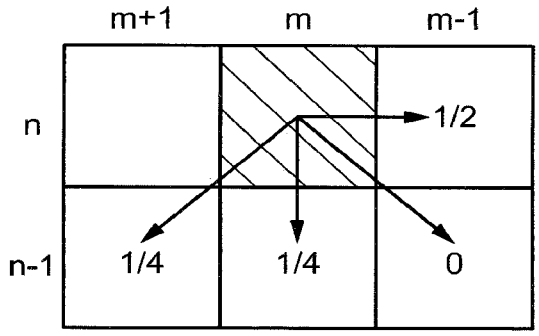
FIG. 16A is a diagram for explaining a vd1_mod(n, m) calculation process according to a gradation of input data shown in FIG. 13.
Figure 16B:
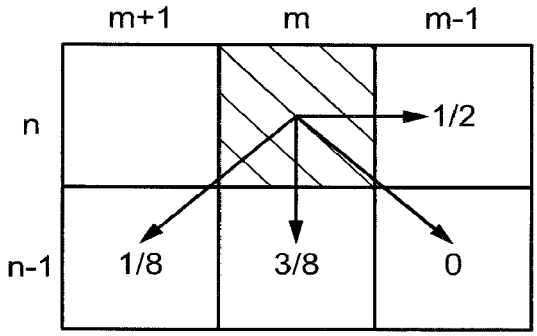
FIG. 16B is a diagram for explaining a vd1_mod(n, m) calculation process according to a gradation of input data shown in FIG. 13.
Figure 16C:
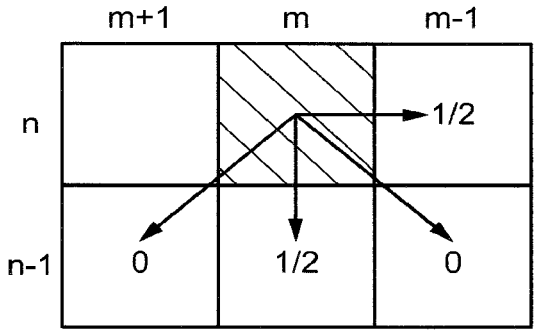
FIG. 16C is a diagram for explaining a vd1_mod(n, m) calculation process according to a gradation of input data shown in FIG. 13.

FIG. 16A, FIG. 16B, and FIG. 16C are diagrams showing specific examples of a calculation process of vd1_mod(n, m) and a calculation process of vd2_mod(n, m) shown in FIG. 13. FIG. 16A shows a specific example of a calculation process of vd1_mod(n, m) in the case when the gradation of the input data vd_in(n, m) is 65 gradations or more. As is shown in an upper surface view of FIG. 16A, a pixel in the horizontal direction with respect to the target pixel PX(n, m) is multiplied by the diffusion error normalization coefficient d=½. Similarly, a pixel in the lower right direction with respect to the target pixel PX(n, m) is multiplied by the diffusion error normalization coefficient a=0. Similarly, a pixel in the vertical direction with respect to the target pixel PX(n, m) is multiplied by the diffusion error normalization coefficient b=¼. Similarly, a pixel in the lower left direction with respect to the target pixel PX(n, m) is multiplied by the diffusion error normalization coefficient c=¼. FIG. 16B shows a specific example of a calculation process of vd1_mod(n, m) in the case where the gradation of the input data vd_in(n, m) is 25 gradations or more and less than 64 gradations. As is shown in an upper surface view of FIG. 16B, a pixel in the horizontal direction with respect to the target pixel PX(n, m) is multiplied by the diffusion error normalization coefficient d=½. Similarly, a pixel in the lower right direction with respect to the target pixel PX(n, m) is multiplied by the diffusion error normalization coefficient a=0. Similarly, a pixel in the vertical direction with respect to the target pixel PX(n, m) is multiplied by the diffusion error normalization coefficient b=⅜. Similarly, a pixel in the lower left direction with respect to the target pixel PX(n, m) is multiplied by the diffusion error normalization coefficient c=⅛. FIG. 16C shows a specific example of a calculation process of vd1_mod(n, m) in the case when the gradation of the input data vd_in(n, m) is less than 25 gradations. As is shown in an upper surface view of FIG. 16C, a pixel in the horizontal direction with respect to the target pixel PX(n, m) is multiplied by the diffusion error normalization coefficient d=½. Similarly, a pixel in the lower right direction with respect to the target pixel PX(n, m) is multiplied by the diffusion error normalization coefficient a=0. Similarly, a pixel in the vertical direction with respect to the target pixel PX(n, m) is multiplied by the diffusion error normalization coefficient b=½. Similarly, a pixel in the lower left direction with respect to the target pixel PX(n, m) is multiplied by the diffusion error normalization coefficient c=0.

In the present embodiment, FIG. 16A, FIG. 16B and FIG. 16C showed examples in which the constants a, b, c and d representing the diffusion error normalization coefficients corresponding to the range of each gradation of the gradation of the input data vd_in(n, m). The range of each gradation of the input data vd_in(n, m) is 65 gradations or more, 25 gradations or more and less than 65 gradations, and less than 25 gradations. However, examples using the constants a, b, c and d representing the diffusion error normalization coefficients are not limited to this example. For example, if it is desired to divide the gradation of the input data vd_in(n, m) into four ranges and to make the block boundary of the error diffusion block BL less apparent, the constants a, b, c, and d representing four diffusion error normalization coefficients according to each gradation range divided into four ranges may be used. It is sufficient to appropriately set according to the extent to which the block boundary of the error diffusion block BL is desired to be less apparent.

As described above, depending on the range of the gradation of the input data vd_in (n, m) in the process of calculating vd1_mod(n, m), the constants a, b, c, and d representing diffusion error normalization coefficients are changed. By performing the gradation processing by the error diffusion method as described above, it is possible to make the block boundary of the error diffusion block BL less apparent. In particular, in the case where the block boundary of the error diffusion block BL is apparent on the low gradation side, by using the image processing device, the image processing method, and the image display system which is mounted with these according to one embodiment of the present invention, a block boundary of a an error diffusion block BL becomes less apparent and it is possible to provide an image processing device capable of displaying a high-quality image, a processing method of the image processing device and an image display system.

Third Embodiment

In the present embodiment, still another example of the image processing device according to one embodiment of the present invention is explained. Furthermore, explanations of structures similar to those of the first embodiment or the second embodiment may be omitted.

Figure 17:
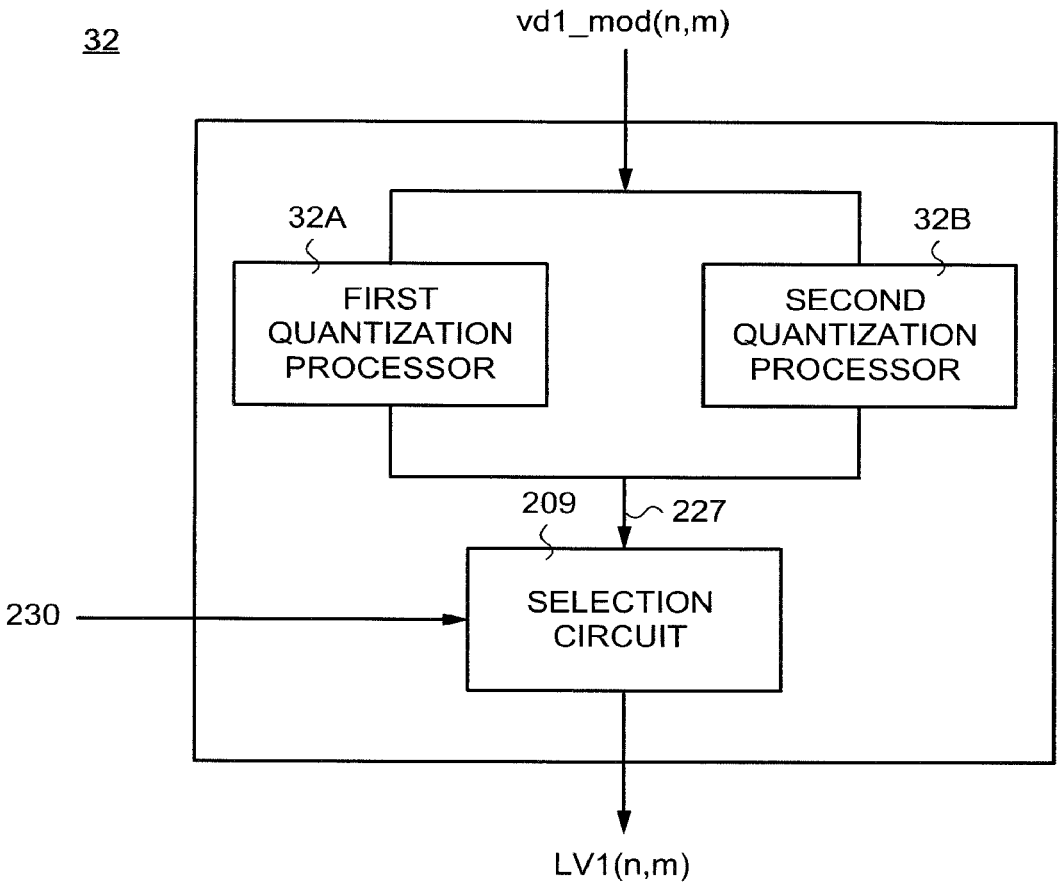
FIG. 17 is a schematic block diagram showing a function block of a first quantized data calculator 32 shown in FIG. 13.

FIG. 17 is a schematic block diagram showing a functional block of the first quantized data calculator 32 shown in FIG. 3.

The first quantized data calculator 32 includes a first quantization processor 32A, a second quantization processor 32B, and a selection circuit 209. The first quantized data calculator 32 is input with the first pixel data vd1_mod(n, m) and the input data vd_in(n, m). In addition, the first quantized data calculator 32 outputs the first quantized data LV1(*n, m*). Furthermore, (n, m) may be input to each functional block and may have a role of linking each data with the coordinates of each data.

The operation of the circuit for calculating the first quantized data LV1(*n, m*) is explained. The first pixel data vd1_mod(n, m) and input data vd_in(n, m) are input to the first quantized data calculator 32. The first pixel data vd1_mod(n, m) is input to the first quantization processor 32A and the second quantization processor 32B. The first quantization processor 32A performs encoding or quantization of gradation of input data from 8 bits to 3 bits. The second quantization processor 32B performs encoding or quantization of gradation of input data from 6 bits to 3 bits. The first quantization processor 32A and the second quantization processor 32B output encoded or quantized data 227.

According to a selection signal 230, the selection circuit 209 selects either the encoded or quantized data from 8 bits to 3 bits or the encoded or quantized data from 6 bits to 3 bits among the encoded or quantized data 227. The first quantized data calculator 32 outputs the first pixel data vd1_mod (n, m). Furthermore, the selection signal 230 may be a signal externally input or a signal generated internally. The circuit structure and functions may be appropriately examined so that the present invention does not depart from the its concept so that it is possible for the selection signal 230 to select either encoded or quantized data from 8 bits to 3 bits or encoded or quantized data from 6 bits to 3 bits.

Figure 18:
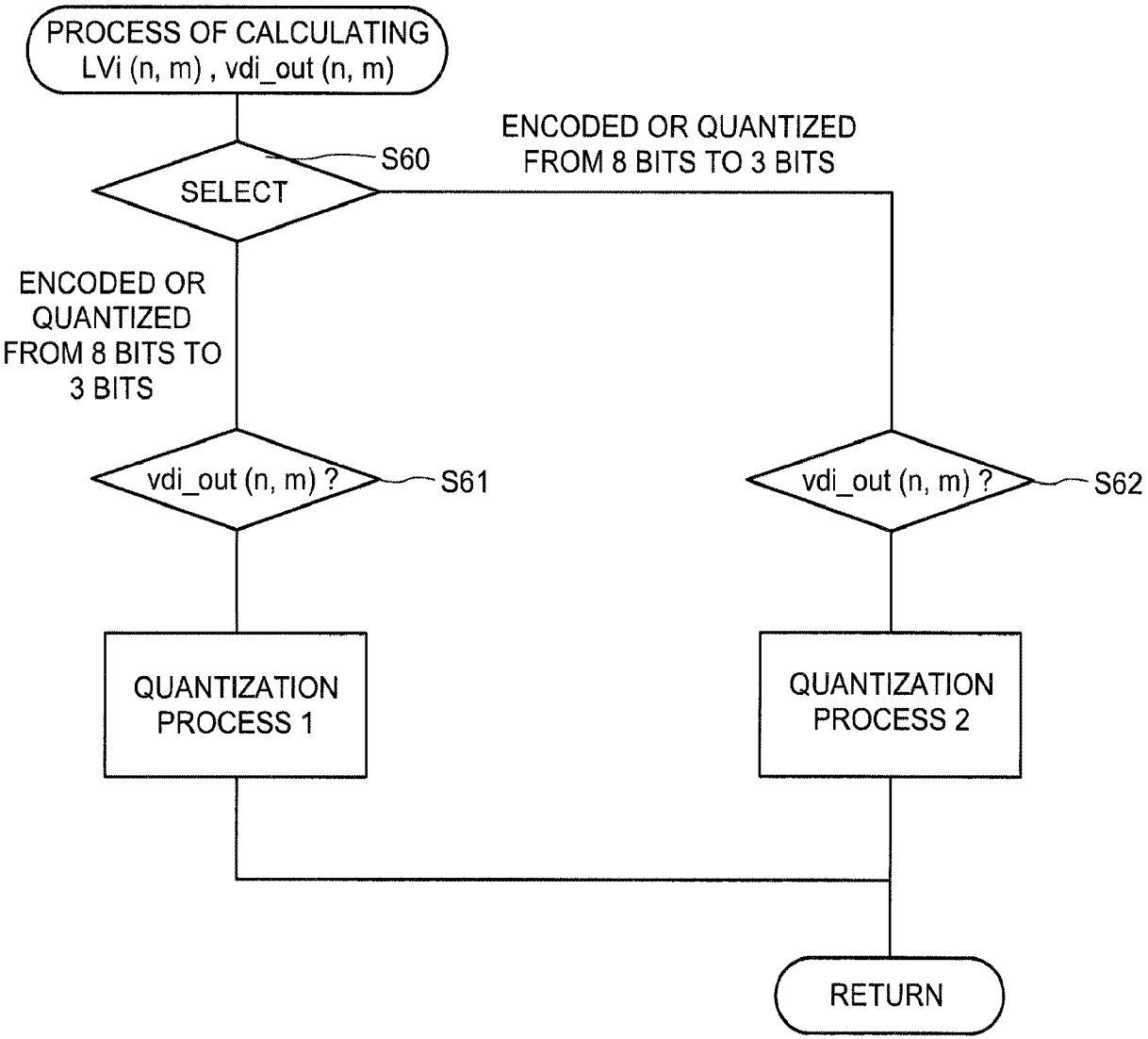
FIG. 18 is a flow diagram showing the details of another embodiment of a LV1(*n, m*), vd1_out(n, m) calculation process and a LV2(*n, m*), vd2_out(n, m) calculation process shown in FIG. 4.
Figure 19:
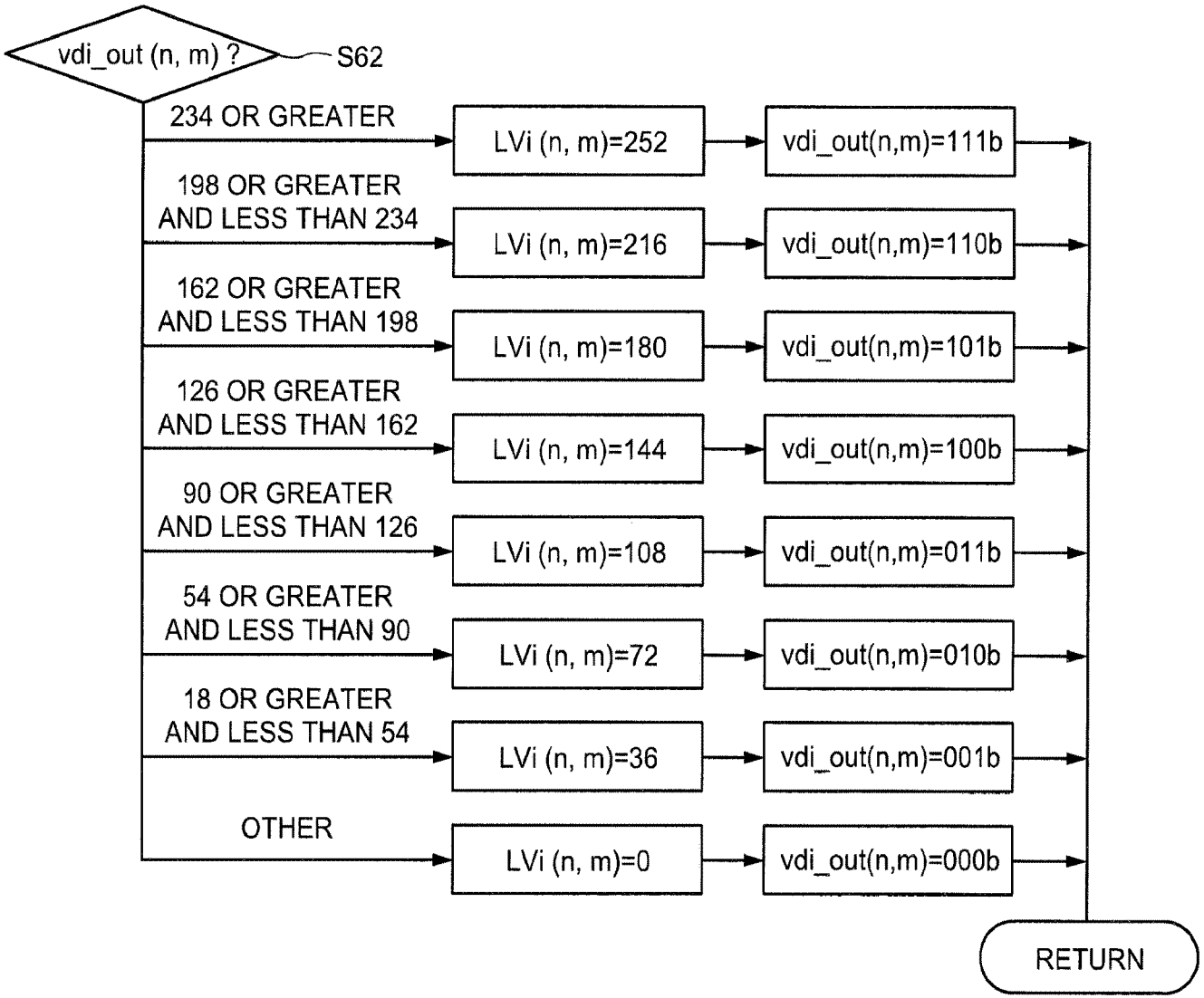
FIG. 19 is a flow diagram showing the details of another embodiment of a LV1(*n, m*), vd1_out(n, m) calculation process and a LV2(*n, m*), vd2_out(n, m) calculation process shown in FIG. 18.

FIG. 18 and FIG. 19 are flowcharts showing details of another embodiment of the process of calculating LV1(*n, m*), vd1_out(n, m) and the process of calculating LV2(*n, m*), vd2_out(n, m) shown in FIG. 4. [i] shown in FIG. 4 is a variable representing [1] or [2]. In the following explanation, although the case of i=1, that is, the process of calculating LV1(*n, m*), vd1_out(n, m) is focused on, the calculation process of LV2(*n, m*), vd2_out(n, m) is the same.

First, according to step S60, the first quantized data calculator 32 selects either encoding or quantizing of the gradation of input data from 8 bits to 3 bits or encoding or quantization of the gradation of the input data from 6 bits to 3 bits to be performed on the first pixel data vd1_mod(n, m).

In the case where the gradation of the input data is selected to be encoded or quantized from 8 bits to 3 bits, a quantization process 1 is performed by the first quantization processor 32A according to step S61. In the case where the gradation of the input data is selected to be encoded or quantized from 6 bits to 3 bits, a quantization process 2 is performed by the second quantization processor 32B according to step S62.

Since the process of the quantization process 1 according to step S61 is the same as step S30 explained in FIG. 10, an explanation here is omitted.

In step S62, the range of values of the first pixel data vd1_mod(n, m) is judged. In the example of FIG. 19, it is judged that the values of the first pixel data vd1_mod(n, m) belong to one of [234 or more], [198 or more and less than 234], [162 or more and less than 198], [126 or more and less than 162], [54 or more and less than 90], [18 or more and less than 54], and [other (less than 18)]. Furthermore, in FIG. 19, the ranges to be judged are eight ranges. This corresponds to the fact that the number which can be expressed by the number of bits 3 of the first output pixel data vd1_out(n, m) is eight types [0] to [7]. Depending on the number of bits of the first output pixel data vd1_out(n, m), the ranges to be judged may be set narrower. In addition, the ranges to be judged may be set less narrow. The narrower the ranges to be judged, the higher the definition of an image can be obtained in the image displayed on the image display system.

The first quantized data calculator 32 calculates the first quantized data LV1(*n, m*) based on the judgement result of step S62. In the example of FIG. 19, for example, in the case when the value of the first pixel data vd1_mod(n, m) is [234 or more], the first quantized data calculator 32 determines the value of the first quantized data LV1(*n, m*) as [252]. Similarly, in the case when the value of the first pixel data vd1_mod(n, m) is [198 or more and less than 234], the first quantized data calculator 32 determines the first quantized data LV1(*n, m*) as [216]. In the case where the value of the first pixel data vd1_mod(n, m) is [162 or more and less than 198], the first quantized data calculator 32 determines the value of the first quantized data LV1(*n, m*) as [180]. In the case where the value of the first pixel data vd1_mod(n, m) is [126 or more and less than 162], the first quantized data calculator 32 determines the value of the first quantized data LV1(*n, m*) as [144]. In the case where the value of the first pixel data vd1_mod(n, m) is [90 or more and less than 126], the first quantized data calculator 32 determines the value of the first quantized data LV1(*n, m*) as [108]. In the case where the value of the first pixel data vd1_mod(n, m) is [54 or more and less than 90], the first quantized data calculator 32 determines the value of the first quantized data LV1(*n, m*) as [72]. In the case where the value of the first pixel data vd1_mod(n, m) is [18 or more and less than 54], the first quantized data calculator 32 determines the value of the first quantized data LV1(*n, m*) as [36]. In the case where the value of the first pixel data vd1_mod(n, m) is [other (less than 18)], the first quantized data calculator 32 determines the value of the first quantized data LV1(*n, m*) as [0].

When the first quantized data LV1(*n, m*) is determined in this way, the first output pixel data calculator 33 next calculates the value of the first output pixel data vd1_out(n, m) which is 3 bit data. More specifically, in the case when the value of the first quantized data LV1(*n, m*) is [252], for example, the first output pixel data calculator 33 sets the value of the first output pixel data vd1_out(n, m) as [111b]. Similarly, in the case when the value of the first quantized data LV1(*n, m*) is [216], the value of the first output pixel data vd1_out(n, m) is set as [110b]. In the case when the value of the first quantized data LV1(*n, m*) is [180], the value of the first output pixel data vd1_out(n, m) is set as [101 b]. In the case when the value of the first quantized data LV1(*n, m*) is [144], the value of the first output pixel data vd1_out(n, m) is set as [100b]. In the case when the value of the first quantized data LV1(*n, m*) is [108], the value of the first output pixel data vd1_out(n, m) is set as [011 b]. In the case when the value of the first quantized data LV1(*n, m*) is [72], the value of the first output pixel data vd1_out(n, m) is set as [010b]. In the case when the value of the first quantized data LV1(*n, m*) is [36], the value of the first output pixel data vd1_out(n, m) is set as [001 b]. In the case when the value of the first quantized data LV1(*n, m*) is [0], the value of the first output pixel data vd1_out(n, m) is set as [000*b*].

As described above, the first quantized data LV1(*n, m*), the first output pixel data vd1_out(n, m), the second quantized data LV2(*n, m*), and the second output pixel data vd2_out(n, m) are calculated.

In the present embodiment, in the process of calculating LV1(*n, m*), vd1_out(n, m), an example of quantization processing is shown using the first quantized data calculator 32 which includes two processors, a first quantization processor 32A for performing encoding or quantization of the gradation of input data from 8 bits to 3 bits, and a second quantization processor 32B for performing encoding or quantization of the gradation of input data from 6 bits to 3 bits. However, the present invention is not limited to this example. For example, a third quantization processor 32C for performing encoding or quantization of the gradation of input data from 4 bits to 3 bits, and a fourth quantization processor 32D for performing encoding or quantization of the gradation of input data from 12 bits to 3 bits may be included so that it is possible to handle gradation of input data or 4 bits or gradation of input data of 12 bits. The quantization process may be appropriately examined according to the extent to which the block boundary of the error diffusion block BL is desired to be less apparent. Furthermore, the second quantized data calculator 34 is the same.

As is described in the present embodiment, since the first quantized data calculator 32 and the second quantized data calculator 34 have a plurality of quantization processors, it is possible to perform image processing using one image processing device with respect to the gradation of a plurality of input data. That is, even if the signal source changes, image processing can be performed by one image processing circuit by using the image processing device illustrated in this embodiment.

Each embodiment described above as embodiments of the present invention can be implemented in combination as appropriate as long as they do not contradict each other.

In the present specification, although an image processing device, image processing method and an image display system in which the image processing device and the image processing method are mounted have mainly been exemplified as disclosed examples, a display device which displays pixel data processed by an image processing device may use another self-light emitting display device, a liquid crystal display device, or an electronic paper type display device having an electrophoretic element, or what is called a flat panel type display device. In addition, the size of the display device can be applied from a medium to small size to a large size without any particular limitations.

Even other actions and effects different from the action and effect brought about by the aspects of each embodiment described above, those which are obvious from the description of the present specification or those that could easily be predicted by a person skilled in the art should naturally be interpreted as being provided by the present invention.

What is claimed is:

1. An image processing device comprising:

a storage part storing an error value corresponding to a second pixel in an image display device, the image display device having a display screen, the display screen having a plurality of pixels, the plurality of pixels having a first pixel and the second pixel, the second pixel surrounding a first pixel;

a pixel data calculator calculating pixel data corresponding to the first pixel based on a coefficient in response to a gradation of an input data in the second pixel and the error value corresponding to the second pixel;

a quantized data calculator quantizing the calculated pixel data and calculating quantized data; and an error value calculator corresponding the calculated pixel data and the error value with the quantized data and storing in the storage part.

2. The image processing device according to claim 1, further comprising a judgement part wherein the judgement part judges whether the first pixel is within a predetermined range, the pixel data calculator calculates the pixel data using the error value corresponding to the second pixel in the case where it is judged that the first pixel is within a predetermined range, and the pixel data calculator calculates the pixel data without using the error value corresponding to the second pixel in the case where it is judged that the first pixel is not within a predetermined range.

3. The image processing device according to claim 1, wherein the pixel data is calculated by adding a value obtained by multiplying the error value corresponding to the second pixel by the coefficient, to an input data corresponding to the first pixel.

4. The image processing device according to claim 1, wherein a range of gradation of the input data is divided into a plurality of sections, and the coefficient used for calculation of the pixel data is different for each section.

5. The image processing device according to claim 4, wherein the range of gradation of the input data has a first section and a second section.

6. The image processing device according to claim 4, the range of gradation of the input data has three or more sections.

7. The image processing device according to claim 4, wherein the coefficient corresponding to a second pixel located in the same scan direction with a scan direction for displaying an image on the image display device, and the coefficient corresponding to a second pixel located in a row scanned immediately before for displaying an image on the image display device are different for each section.

8. The image processing device according to claim 7, wherein at least one coefficient among coefficients different for each section is 0.

9. The image processing device according to claim 1, further comprising an output pixel data calculator, wherein the output pixel data calculator is arranged for calculating output pixel data obtained by being quantized.

10. The image processing device according to claim 1, wherein the quantization is converting 8 bit data or 6 bit data to 3 bit data.

11. A display system comprising:

the image processing device according to claim 1, and an image display device including a display screen having a plurality of pixels; wherein a gradation of each of the pixels is controlled based on data on which error diffusion processing is performed by the image processing device.

12. An image processing method comprising:

dividing a display screen into a plurality of regions and performing an error diffusion process on input data input to an image processing device including the display screen having a plurality of pixels;

storing an error value corresponding to the pixel in a storage part;

calculating pixel data corresponding to a first pixel based on a coefficient in response to a gradation of the input data in a second pixel and the error value corresponding to the second pixel surrounding the first pixel included in the plurality of pixels;

quantizing the pixel data and calculating quantized data;

calculating the error value based on the pixel data and the quantized data; and corresponding the error value with the first pixel and storing in the storage part.

13. The image processing method according to claim 12, wherein calculating the pixel data using at least the error value corresponding to the second pixel in the case where it is judged that the first pixel is within a predetermined range, and calculating the pixel data without using the error value corresponding to the second pixel in the case where it is judged that the first pixel is not within a predetermined range.

14. The image processing method according to claim 12, wherein calculation of the pixel data is performed by multiplying the error value by the coefficient and adding the multiplied value to input data corresponding to the first pixel.

15. The image processing method according to claim 12, wherein gradation of the input data is divided into a plurality of sections, and the coefficient used for calculation of the pixel data is different for each section.

16. The image processing method according to claim 15, wherein a range of gradation of the input data has a first section and a second section.

17. The image processing method according to claim 15, wherein a range of gradation of the input data has three or more sections.

18. The image processing method according to claim 12, wherein the quantization is converting 8 bit data or 6 bit data to 3 bit data.

* * * * *